US009719678B2

(12) United States Patent
Gamezo et al.

(10) Patent No.: US 9,719,678 B2
(45) Date of Patent: Aug. 1, 2017

(54) APPARATUS METHODS AND SYSTEMS OF UNIDIRECTIONAL PROPAGATION OF GASEOUS DETONATIONS

(75) Inventors: Vadim N. Gamezo, Fairfax, VA (US); Elaine S. Oran, Falls Church, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 1060 days.

(21) Appl. No.: 13/241,009

(22) Filed: Sep. 22, 2011

(65) Prior Publication Data

US 2012/0070790 A1 Mar. 22, 2012

Related U.S. Application Data

(60) Provisional application No. 61/385,455, filed on Sep. 22, 2010.

(51) Int. Cl.
*F23D 14/82* (2006.01)

(52) U.S. Cl.
CPC ..... *F23D 14/82* (2013.01)

(58) Field of Classification Search
CPC ..... F24D 14/82
See application file for complete search history.

(56) References Cited

U.S. PATENT DOCUMENTS 1,021,742 A * 3/1912 Moore ..... 181/223
1,329,559 A * 2/1920 Tesla ..... 138/37
1,976,870 A * 10/1934 Weber ..... 431/191
2,411,798 A * 11/1946 Matthews ..... 415/117
2,612,749 A * 10/1952 Tenney ..... F02K 7/04 60/249
3,444,879 A * 5/1969 McLeod, Jr. ..... 137/814
3,674,409 A * 7/1972 Desty ..... 431/1
3,730,673 A * 5/1973 Straitz, III ..... 431/278
4,351,294 A * 9/1982 Giddings ..... 123/291
4,975,098 A 12/1990 Lee
5,265,636 A * 11/1993 Reed ..... 137/14
(Continued)

OTHER PUBLICATIONS

1956; Kogarko; Possibility of the Detonation of Gas Mixtures in Conical Tubes; Institute of Chemical Physics of the Academy of Sciences of the USSR; pp. 409-416; vol. 5, No. 4; USSR.

(Continued)

*Primary Examiner* — Avinash Savani
*Assistant Examiner* — Deepak Deean
(74) *Attorney, Agent, or Firm* — US Naval Research Laboratory; Richard F. Bis

(57) ABSTRACT

The detonation propagation in a channel geometry which suppresses detonation propagation in one direction, allows it in another direction, and does not create flow restrictions in the channel. The geometry consists of a series of divergent sections separated by wedges that form a sawtooth shape. The detonation fails to propagate through this geometry in one direction because the detonation front is weakened by diffraction, and reignition centers are isolated from the main channel. In an opposite direction, convergent parts of the geometry support the detonation propagation, because subsequent shock collisions with oblique walls that form convergent sections create powerful transverse waves. These powerful transverse waves help the detonation propagation or reignite it.

11 Claims, 17 Drawing Sheets

(56) References Cited

U.S. PATENT DOCUMENTS

| | | | | |
|---|---|---|---|---|
| 5,303,275 | A * | 4/1994 | Kobsa | 376/352 |
| 5,676,712 | A * | 10/1997 | Anderson | 48/192 |
| 5,794,707 | A * | 8/1998 | Alhamad | 169/69 |
| 6,105,676 | A * | 8/2000 | Alhamad | 169/45 |
| 6,311,738 | B1 * | 11/2001 | Mason | 141/18 |
| 6,637,211 | B1 * | 10/2003 | Swift et al. | 62/6 |
| 6,877,310 | B2 * | 4/2005 | Leyva | 60/247 |
| 7,055,308 | B2 * | 6/2006 | Pinard | F02C 5/00 181/220 |
| 2007/0137172 | A1 * | 6/2007 | Rasheed et al. | 60/39.76 |
| 2009/0019720 | A1 * | 1/2009 | Grobler et al. | 34/365 |
| 2009/0320439 | A1 * | 12/2009 | Chapin et al. | 60/39.38 |
| 2012/0047873 | A1 * | 3/2012 | Gutmark | F23C 15/00 60/247 |
| 2012/0216504 | A1 * | 8/2012 | Snyder | F23M 9/06 60/39.76 |
| 2012/0324860 | A1 * | 12/2012 | Shimo | F02C 3/165 60/39.76 |
| 2013/0140038 | A1 * | 6/2013 | Fripp | E21B 43/12 166/373 |
| 2014/0151062 | A1 * | 6/2014 | Stephenson | E21B 21/01 166/373 |
| 2015/0059718 | A1 * | 3/2015 | Claywell | F01M 13/04 123/572 |

OTHER PUBLICATIONS

1956; Zel'Dovich, et al.; An Experimental Investigation of Spherical Detonation of Gases; Soviet Physics, Tech. Phys.; pp. 1689-1713; vol. 1; USSR.

Jun. 1965; Mitrofanov, et al.; The Diffraction of Multifront Detonation Waves; Soviet Physics; pp. 1055-1058; vol. 9, No. 12; Hydrodynamics Institute, Siberian Division of the Academy of Sciences of the USSR.

1979; Edwards, et al.; The diffraction of a planar detontion wave at an abrupt area change; Journal of Fluid Mechanics; pp. 79-96; vol. 95, part 1; Cambridge University Press; Great Britain.

1979; Matsui, et al.; On The Measure of the Relative Detonation Hazards of Gaseous Fuel-Oxygen and Air Mixtures; pp. 1269-1280; vol. 17; Proceedings of the Combustion Institute.

Sep.-Oct. 1982; Gubin, et al.; Experimental Study of Gas Detonation in Conical Tubes; pp. 111-117; translated from Fizika Goreniya i Vzryva; vol. 18, No. 5; (Plenum Publishing Corp. 1983) & Moscow.

1982; Knystautas, et al.; The Critical Tube Diameter for Detonation Failure in Hydrocarbon-Air Mixtures; Combustion And Flame; pp. 63-83; vol. 48; The Combustion Institute; Elsevier Science Publishing; New York; United States.

1985; Thomas, et al.; Detonation Diffraction by Divergent Channels; Presented at 10th ICDERS, Berkley, California; pp. 144-154; American Institute of Aeronautics and Astronautics; United States.

1986; Bartlma, et al.; The Diffraction of a Plane Detonation Wave at a Convex Corner; Combustion And Flame; pp. 237-248; vol. 66; Elsevier Science Publishing, New York; United States.

1988; Dupre, et al.; Propagation of Detonation Waves in an Acoustic Absorbing Walled Tube; Journal of Dynamics of Explosions; pp. 248-263; vol. 114; American Institute of Aeronautics and Astronautics; United States.

1995; Teodorczyk, et al.; Detonation attenuation by foams and wire meshes lining the walls; Shock Waves; pp. 225-236; vol. 4; Springer-Verlag.

1995; Jones, et al.; Reignition of detonations by reflected shocks; Shock Waves; pp. 47-57; vol. 5; Springer-Verlag.

1996; Jones, et al.; The influence of cellular structure on detonation transmission; Shock Waves; pp. 119-129; vol. 6; Springer-Verlag.

2000; Jones, et al.; Numerical simulation of detonation reignition in H2—O2 mixtures in area expansions; Shock Waves; pp. 23-41; vol. 10; Springer-Verlag.

2002; Thomas, et al.; Detonation interaction with wedges and bends; Shock Waves; pp. 481-492; vol. 11; Springer-Verlag.

2002; Radulescu, et al.; The Failure Mechanism of Gaseous Detonations: Experiments in Porous Wall Tubes; Combustion And Flame; pp. 29-46; vol. 131; The Combustion Institute; Elsevier Science Publishing; United States.

2002; Grossel, Stanley S.; Deflagration and Detonation Flame Arresters; pp. 1-138; American Institute of Chemical Engineers; New York; United States.

2005; Khasainov, et al.; Detonation diffraction from circular tubes to cones; Shock Waves; pp. 187-192; vol. 14; Springer-Verlag.

2008; Gamezo, et al.; Flame acceleration and DDT in channels with obstacles: Effect of obstacle spacing; Combustion And Flame; pp. 302-315; vol. 155; The Combustion Institute; Elsevier Science Publishing; United States.

2008; Sorin, et al.; Detonation diffraction through different geometries; Shock Waves; pp. 11-23; vol. 19; Springer-Verlag.

2008; Lee, John H. S.; The Detonation Phenomenon; pp. 1-388; Cambridge University Press; New York; United States.

2009; Pintgen, et al.; Detonation diffraction in gases; Combustion And Flame; pp. 665-677; vol. 156; The Combustion Institute; Elsevier Science Publishing; United States.

* cited by examiner

APPARATUS METHODS AND SYSTEMS OF UNIDIRECTIONAL PROPAGATION OF GASEOUS DETONATIONS

CROSS REFERENCE TO RELATED APPLICATION

Pursuant to 35 USC §120, the present application is related to US Provisional Application for Patent No. 61/385,455, APPARATUS FOR UNDIRECTIONAL PROPAGATION OF GAS DETONATIONS, for which the right of priority is claimed and the entire disclosure of which is incorporated by reference herein.

FIELD OF THE INVENTION

The present invention in general relates to the detonation propagation of reactive mixtures of gaseous matter. More particularly, the present invention presents a method and system for arresting gas mixture detonations in one direction, while propagating such detonations in another direction, thus controlling the propagation of gas detonations in various channels, analogously as a (detonation) diode. The method and system presented herein have applications in industrial pipelines and can have a positive effect on public safety, welfare and health.

BACKGROUND OF THE INVENTION

A detonation wave ignited in a geometrically unconfined homogeneous reactive gas mixture usually spreads in all directions from the ignition point. For a confined system, the detonation propagation may be affected by the confinement geometry, which can, in some cases, lead to detonation failure. According to S. S. Grossek, "Deflagration and Detonation flame Arresters", American Institute of Chemical Engineers, New York, 2002, geometries that cause detonation failure are often used in detonation arresters to prevent the detonation from propagating through industrial pipelines. Detonation arresters are usually designed to stop both detonations and deflagrations, and the resulting geometries are often complex and create significant flow restrictions. If focusing only on quenching detonations, there are a few relatively simple ways to decouple the flame from the shock without putting obstructions in the flow.

One way to prevent a detonation from propagating through a channel is to line the channel walls with a porous material that damps transverse waves (see: G. Dupre, O. Peraldi, J. H. S. Lee, R. Knystautas, "Propagation of detonation waves in an acoustic absorbing walled tube" *Prog. Astronaut. Aeronaut.* 114 (1988) 248-263; also see A. Teodorczyk, J. H. S. Lee, "Detonation attenuation by foams and wire meshes lining the walls". *Shock Waves* 4 (1995) 225-236; and also see M. I. Radulescu, and J. H. S. Lee, "The Failure Mechanism of Gaseous Detonations: Experiments in Porous Wall Tubes". *Combust. Flame* 131 (2002) 29-46). Damping transverse waves weakens and destroys triple-shock configurations that are largely responsible for the energy release in a gaseous detonation wave, and the detonation eventually fails.

Another way to quench a detonation by decoupling the flame from the shock without putting obstructions in the flow is to use detonation diffraction phenomena (which is an interaction of a detonation wave with a divergent geometry) that may quench a detonation propagating from a smaller to a larger channel. Inserting a cylindrical expansion section of a larger diameter into a pipeline may stop a detonation if the pipeline diameter is small enough. Detonation diffraction is discussed in detail in the following references: (Y. B. Zeldovich, S. M. Kogarko, & N. N. Simonov, "An experiment investigation of spherical detonation in gases", *Soy. Phys. Tech. Phys.* 1(1956) 1689-1713; S. M. Kogarko, "On the possibility of detonation of gaseous mixtures in conical tubes", *Izvestia Akad. Nauk SSSR, OKhN,* 4(1956) 419-426; V. V. Mitrofanov, R. I. Soloukhin, "The diffraction of multifront detonation waves". *Sov. Phys. Dokl.* 9(1965) 1055-1058; D. H. Edwards, G. O. Thomas, M. A. Nettleton, "The diffraction of a planar detonation wave at an abrupt area change". *J. Fluid Mech.* 95(1979) 79-96; H. Matsui, J. H. S. Lee, "On the Measure of the Relative Detonation Hazards of Gaseous fuel-Oxygen and Air Mixtures". *Proc. Combust. Inst.* 17(1979) 1269-1280; R. Knystautas, J. H. S. Lee, C. M. Guirao, "The critical tube diameter for detonation failure in hydrocarbonair mixtures". *Combust. Flame* 48(1982) 63-83; S. A. Gubin, S. M. Kogarko, V. N. Mikhalkin, "Experimental studies into gaseous detonations in conical tubes". *Combust. Expl. Shock Waves* 18(1982) 592-597; G. O. Thomas, D. H. Edwards, J. H. S. Lee, R. Knystautus, I. O. Moen, "Detonation diffraction by divergent channels". *Prog. Astranaut. Aeronaut.* 106(1986) 144-154; F. Bartlma, K. Schroder, "The Diffraction of a Plane Detonation Wave at a Convex Corner". *Combust. Flame* 66(1986) 237-248; D. A. Jones, M. Sichel, E. S. Oran, "Reignition of Detonations by Reflected Shocks". *Shock Waves* 5(1995) 47-57; D. A. Jones, G. Kemister, E. S. Oran, M. Sichel, "The Influence of Cellular Structure on Detonation Transmission". *Shock Waves* 6(1996) 119-130; D. A. Jones, G. Kemister, N. A. Tonello, E. S. Oran, M. Sichel, "Numerical Simulation of Detonation Reignition in $H_2$—$O_2$ Mixtures in Area Expansion". *Shock Waves* 10(2000) 33-41; G. O. Thomas, R. Ll. Williams, "Detonation interaction with wedges and bends". *Shock Waves* 11(2002) 481-492; B. Khasainov, H.-N. Presles, D. Desbordes, P. Demontis, P. Vidal, "Detonation diffraction from circular tubes to cones". *Shock Waves* 14(2005) 187-192; J. H. S. Lee, "The Detonation Phenomenon", *Cambridge Univ. Press*, (Cambridge, 2008); and F. Pintgen, J. E. Shepherd, "Detonation diffraction in gases". Combust. And Flame 156(2009) 665-677).

According to the following publications (V. V. Mitrofanov, R. I. Soloukhin, "The diffraction of multifront detonation waves". *Soy. Phys. Dokl.* 9(1965) 1055-1058; D. H. Edwards, G. O. Thomas, M. A. Nettleton, "The diffraction of a planar detonation wave at an abrupt area change". *J. Fluid Mech.* 95(1979) 79-96; and R. Knystautas, J. H. S. Lee, C. M. Guirao, "The critical tube diameter for detonation failure in hydrocarbonair mixtures". *Combust. Flame* 48(1982) 63-83): Experiments show that the detonation exiting from a tube to a large volume fails when the tube diameter is smaller than approximately 13 detonation cells. For a limited expansion section, however, the detonation can reignite when shocks produced by the failed detonation reflect from walls. These shock reflections may ether ignite a new detonation directly or promote a deflagration-to-detonation transition (DDT) in the expansion section. The probability of DDT may even increase for a larger expansion section, thus making this simple geometry unreliable for detonation quenching.

Therefore, the need exists for a method of preventing a detonation from propagating through a channel without creating flow restrictions in the channel. Further, the need exists for a geometry that would provide a more reliable detonation quenching.

SUMMARY OF THE INVENTION

Exemplary embodiments include methods and systems using Channel Geometry and Detonation Quenching:

The 2D channel geometry shown in FIG. 1A is a cross-section view consisting of three consecutive divergent sections, which create a sawtooth shape on the top wall (also referred to herein as consecutive divergent sawtooth sections 122, see FIG. 1A; also see FIG. 1C for a 3D cross-section view of the consecutive divergent sawtooth sections 122). FIG. 1A and FIG. 1C, show the consecutive divergent sawtooth sections 122 comprising at least three pocket(s) 104 and at least two wedge(s) 102 having sharp tips in the consecutive divergent sawtooth sections 122; however, the consecutive divergent sawtooth sections 122 can be composed of more than three pocket(s) 104 or less than three pocket(s) 104 and concomitant features, including more or less than two wedge(s) 102. The bottom wall is flat, but (referring to FIG. 4A) it can also be considered as a symmetry plane for a larger channel with consecutive divergent sawtooth sections 122 on at least both walls (thus, any consecutive divergent sawtooth section 122 can be on more than one wall and/or surface in any given channel, see FIG. 4A). The three consecutive divergent sawtooth section(s) 122 are separated by wedge(s) 102; and these wedge(s) 102 are designed to play several roles.

First, each wedge 102 forms the wall of the next divergent section that causes a diffraction of a detonation front propagating from the left to the right. According to the following references (S. M. Kogarko, "On the possibility of detonation of gaseous mixtures in conical tubes", *Izvestia Akad. Nauk SSSR, OKhN,* 4(1956) 419-426; S. A. Gubin, S. M. Kogarko, V. N. Mikhalkin, "Experimental studies into gaseous detonations in conical tubes". *Combust. Expl. Shock Waves* 18(1982) 592-597; G. O. Thomas, D. H. Edwards, J. H. S. Lee, R. Knystautus, I. O. Moen, "Detonation diffraction by divergent channels". *Prog. Astranaut. Aeronaut.* 106(1986) 144-154; F. Bartlma, K. Schroder, "The Diffraction of a Plane Detonation Wave at a Convex Corner". *Combust. Flame* 66(1986) 237-248; G. O. Thomas, R. Ll. Williams, "Detonation interaction with wedges and bends". *Shock Waves* 11(2002) 481-492; and B. Khasainov, H.-N. Presles, D. Desbordes, P. Demontis, P. Vidal, "Detonation diffraction from circular tubes to cones". *Shock Waves* 14(2005) 187-192): Referring to FIG. 1A, experiments with divergent channels, such as the consecutive divergent sawtooth sections 122, show that diffraction weakens the detonation front so that the shock 108 and flame 106 decouple if the angle $\alpha$ 114 is large enough.

Second (referring again to FIG. 1A), the sharp tips of the wedge(s) 102 are pointed roughly perpendicular to the diffracting detonation front, as shown in FIG. 1A. This minimizes the probability of ignition when the shock 108 hits the tip of the wedge 102.

Third (referring to FIG. 1A, FIG. 1B, FIG. 1C, FIG. 2D, FIG. 2E, FIG. 2F, FIG. 4A, FIG. 5A, FIG. 5B, and FIG. 6), a pocket 104 of gas above each wedge 102 becomes isolated from the rest of the unburned material when the flame 106 reaches the tip of the wedge 102, as shown in FIG. 1A, FIG. 1B, FIG. 1C, FIG. 2D, FIG. 2E and FIG. 2F. When the shock 108 and flame 106 are decoupled, shock 108 reflections in the pocket 104 trigger a new detonation in the pocket 104, but it will not spread to the channel 101 (see FIG. 1B and FIG. 1C). The exact shape of the pocket 104 is not important, but it should be deep enough to allow the flame 106 to reach the tip of the wedge(s) 102 before the shock 108 reaches the end of the pocket 104.

Thus, the sawtooth geometry shown in FIG. 1A, FIG. 1B, FIG. 1C, FIG. 4A, causes the detonation to continually weaken as it propagates in one direction through a series of the consecutive divergent sawtooth sections, as shown in the numerical simulation illustrated in FIG. 2A through FIG. 2L. The geometries depicted in FIG. 1A, FIG. 1B, FIG. 1C, FIG. 4A, FIG. 4B, FIG. 4C, FIG. 5A, FIG. 5B and FIG. 6 are not designed to prevent a detonation from propagating in the opposite direction. These geometries are simple and do not obstruct the flow of gaseous mixture through the channel 101 (these same properties hold for channels 401, 501 and 601 (see FIG. 4A, FIG. 4B, FIG. 4C, FIG. 5A, FIG. 5B, and FIG. 6 respectively). The geometry parameters specified in the caption of FIG. 1A and FIG. 1B were determined in a series of numerical simulations.

DETAILED DESCRIPTION OF THE INVENTION

Figure 1A:
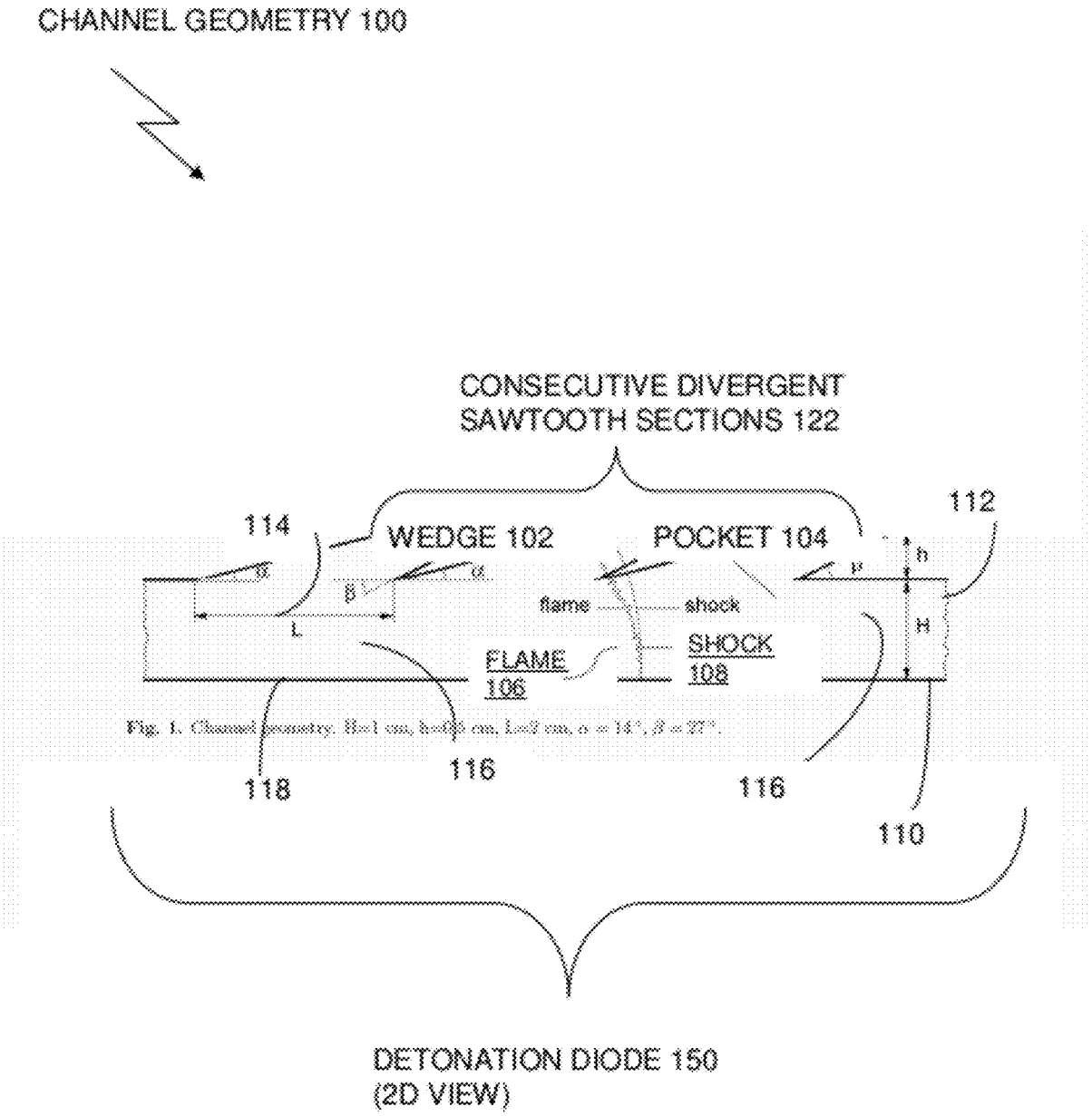
FIG. 1A illustrates a two dimensional (2D) cross-section view of an upper half channel geometry 100, where H=1 cm, h=0.5 cm, L=2 cm, $\alpha$=14 degrees, $\beta$=27 degrees.

Preferred exemplary embodiments of the present invention are now described with reference to the figures, in which like reference numerals are generally used to indicate identical or functionally similar elements. While specific details of the preferred exemplary embodiments are discussed, it should be understood that this is done for illustrative purposes only. A person skilled in the relevant art will recognize that other configurations and arrangements can be used without departing from the spirit and scope of the preferred exemplary embodiments. It will also be apparent to a person skilled in the relevant art that this invention can also be employed in other applications. Further, the terms "a", "an", "first", "second" and "third" etc. used herein do not denote limitations of quantity, but rather denote the presence of one or more of the referenced items(s).

In exemplary embodiments, referring to FIG. 1A, and in accordance with the following references (Vadim N. Gamezo and Elaine S. Oran "Unidirectional Propagation of Gas Detonations in Channels with Sawtooth Walls". *Laboratory for Computational Physics and Fluid Dynamics* (Naval Research Laboratory, Washington, D.C. 20375); S. M. Kogarko, "On the possibility of detonation of gaseous mixtures in conical tubes", *Izvestia Akad. Nauk SSSR, OKhN,* 4(1956) 419-426; S. A. Gubin, S. M. Kogarko, V. N. Mikhalkin, "Experimental studies into gaseous detonations in conical tubes". *Combust. Expl. Shock Waves* 18(1982) 592-597; G. O. Thomas, D. H. Edwards, J. H. S. Lee, R. Knystautus, I. O. Moen, "Detonation diffraction by divergent channels". *Prog. Astranaut. Aeronaut.* 106(1986) 144-154; F. Bartlma, K. Schroder, "The Diffraction of a Plane Detonation Wave at a Convex Corner". *Combust. Flame* 66(1986) 237-248; G. O. Thomas, R. Ll. Williams, "Detonation interaction with wedges and bends". *Shock Waves* 11(2002) 481-492; and B. Khasainov, H.-N. Presles, D. Desbordes, P. Demontis, P. Vidal, "Detonation diffraction from circular tubes to cones". *Shock Waves* 14(2005) 187-192): a more complex geometry that relies on detonation diffraction phenomena observed in divergent channels to quench detonations propagating in one direction is considered. Detonation propagation and extinction in a channel with a sawtooth shaped wall and/or surface are analyzed using two-dimensional (2D) numerical simulations (see FIG. 1A).

Exemplary embodiments (referring to FIG. 1A, FIG. 1B, FIG. 1C, FIG. 2A-FIG. 2L, FIG. 3A-FIG. 3L, FIG. 4A, FIG. 4B, FIG. 4C, FIG. 5A, FIG. 5B, and FIG. 6) consider the detonation propagation in a channel geometry that suppresses detonation propagation in one direction, allows it in another direction, and does not create flow restrictions in the channel. The geometry consists of a series of consecutive divergent sawtooth section(s) 122 separated by wedge(s) 102 which form the sawtooth shape of the consecutive divergent sawtooth section(s) 122, as illustrated in cross-section views in FIG. 1A, FIG. 1B, FIG. 1C, FIG. 4A, and FIG. 6. Numerical simulation shows that the detonation fails to propagate through this geometry in one direction because the detonation front is weakened by diffraction, and reignition centers are isolated from the main channel (see FIG. 1A, FIG. 1B, FIG. 1C, FIG. 2A, FIG. 2B, FIG. 2C, FIG. 2D, FIG. 2E, FIG. 2F, FIG. 2G, FIG. 2H, FIG. 2I, FIG. 2J, FIG. 2K, and FIG. 2L). In an opposite direction, convergent parts of the geometry support the detonation propagation (thus, supporting the analogy of a detonation diode (i.e., analogous to a diode component, as used in electronics technology)—see FIG. 3A, FIG. 3B, FIG. 3C, FIG. 3D, FIG. 3E, FIG. 3F, FIG. 3G, FIG. 3H, FIG. 3I, FIG. 3J, FIG. 3K, and FIG. 3L).

The numerical model is similar to the model used as discussed in V. N. Gamezo, T. Ogawa, E. S. Oran. "Flame Acceleration and DDT in Channels with Obstacles: Effect of Obstacle Spacing". *Combust. Flame* 155 (2008) 302-315. Here, however, the reactive Euler equations are solved and the molecular transport processes are neglected. The Euler equations are solved on an adaptive CARTESIAN mesh using a second-order GODUNOV-type numerical method that incorporates a RIEMANN solver. The reactive system is described by a one-step ARRHENIUS kinetics of energy release. The model parameters summarized in V. N. Gamezo, T. Ogawa, E. S. Oran. "Flame Acceleration and DDT in Channels with Obstacles: Effect of Obstacle Spacing". *Combust. Flame* 155 (2008) 302-315, approximate a stoichiometric hydrogen-air mixture at 1 atm. Computations were performed with the minimum computational cell size dxmin=$1/2048$ cm, which corresponds to 39 computational cells per half-reaction zone length of ZND detonation xd (where ZND is the ZELDOVICH-VON NEUMANN-DORING one-dimensional model of a steady-state detonation wave).

Detailed numerical simulations as discussed in V. N. Gamezo, T. Ogawa, E. S. Oran. "Flame Acceleration and DDT in Channels with Obstacles: Effect of Obstacle Spacing'. *Combust. Flame* 155 (2008) 302-315 of a quasi-steady state detonation in this system performed with the same numerical resolution show a very irregular detonation cell structure with a typical cell size 1-2 cm, which corresponds to 50-100 xd. A fine cellular substructure was observed as well, which is expected for the system with the high activation energy $Ea/RT_{ZND}=13.4$.

Figure 1B:
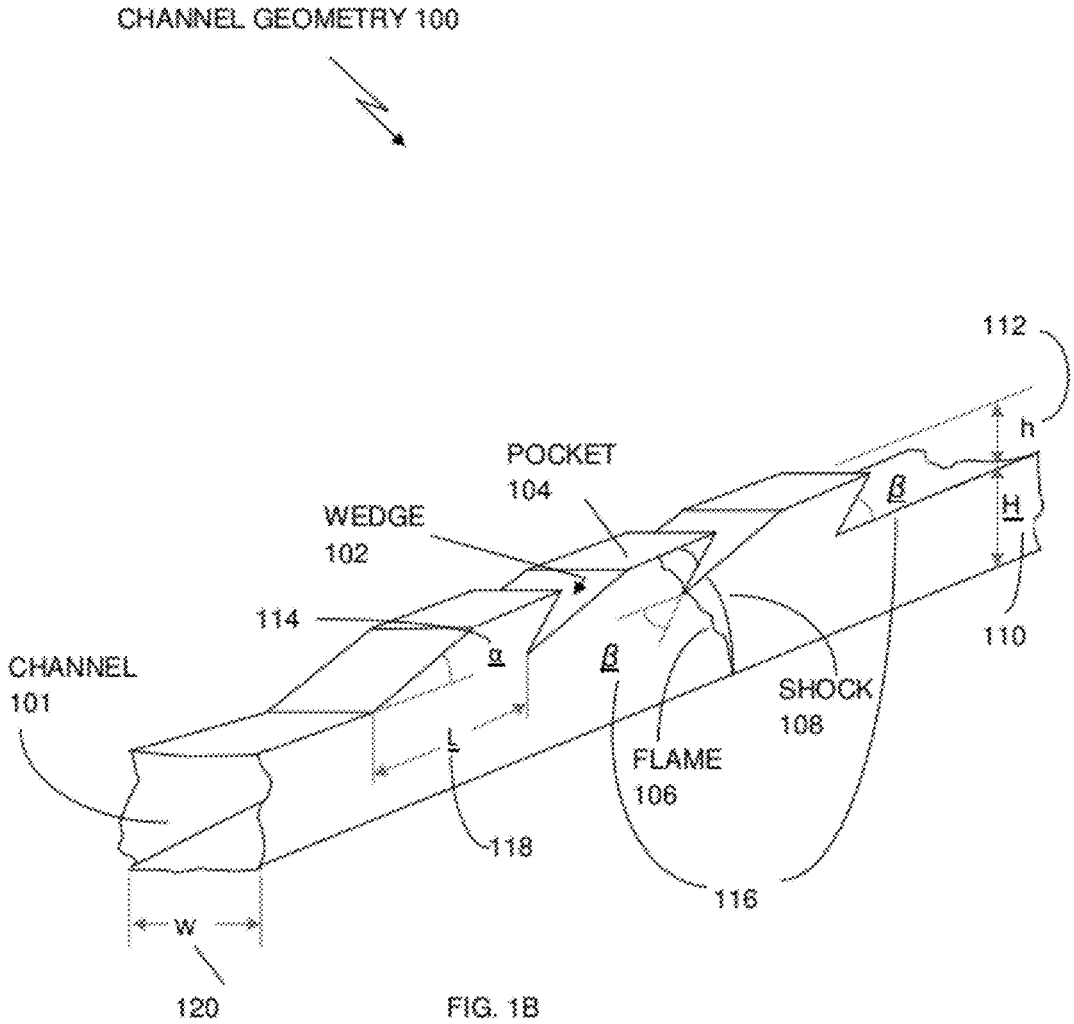
FIG. 1B illustrates a three dimensional (3D) cross-section view of the upper half channel geometry 100, where H=1 cm, h=0.5 cm, L=2 cm, $\alpha$=14 degrees, degrees, $\beta$=27 degrees for any width W of the rectangular channel 101.

Referring to FIG. 1A and FIG. 1B, to model the detonation propagation through the geometry shown in FIG. 1A (also see FIG. 1B), a channel 14 cm long and 1 cm high (see channel 101 of FIG. 1B), with the sawtooth geometry (i.e., the consecutive divergent sawtooth section(s) 122) spanning 6 cm in the middle of the channel is configured. This means that the first divergent section starts 4 cm from the left end of the channel 101 (where, the "left end" is also referred to herein as the "anterior end" and/or "anterior view"). (Also, the right end of the channel 101 is herein referred to as either the "opposite end" and/or the "posterior end" and/or the "posterior view"). The channel 101 is closed at both ends and filled with a reactive gaseous mixture.

A detonation is initiated near the left end of the channel by placing three small circular areas of burned material in front of a MACH 5 planar shock. By the time the detonation reaches the divergent section (see the consecutive divergent sawtooth section 122 of FIG. 1A, FIG. 1B, and FIG. 2A through FIG. 2L), it is propagating with a velocity close to Dcj (where Dcj is the ideal detonation velocity according to the CHAPMAN-JOUGUET model) and develops a cellular structure independent of the initial perturbation. The detonation remains slightly overdriven in the sense that the cell size is smaller than the average 1-2 cm expected for this system as discussed in V. N. Gamezo, T. Ogawa, E. S. Oran. "Flame Acceleration and DDT in Channels with Obstacles: Effect of Obstacle Spacing". *Combust. Flame* 155 (2008) 302-315. This provides a relatively consistent set of initial conditions for detonation diffraction in the system with a highly irregular cell structure.

Referring to FIG. 1A, FIG. 1B, and FIG. 2A through FIG. 2L, according to exemplary embodiments, the evolution of a detonation wave propagating through the sawtooth section is shown in FIG. 2A through FIG. 2L. As the detonation enters the divergent part of the channel 101, the lateral rarefaction begins to weaken transverse waves and increase the detonation cell size. According to the following references (S. M. Kogarko, "On the possibility of detonation of gaseous mixtures in conical tubes", *Izvestia Akad. Nauk SSSR, OKhN,* 4(1956) 419-426; S. A. Gubin, S. M. Kogarko, V. N. Mikhalkin, "Experimental studies into gaseous detonations in conical tubes". *Combust. Expl. Shock Waves* 18(1982) 592-597; G. O. Thomas, D. H. Edwards, J. H. S. Lee, R. Knystautus, I. O. Moen, "Detonation diffraction by divergent channels". *Prog. Astranaut. Aeronaut.* 106(1986) 144-154; F. Bartlma, K. Schroder, "The Diffraction of a Plane Detonation Wave at a Convex Corner". *Combust. Flame* 66(1986) 237-248; G. O. Thomas, R. Ll. Williams, "Detonation interaction with wedges and bends". *Shock Waves* 11(2002) 481-492; and B. Khasainov, H.-N. Presles, D. Desbordes, P. Demontis, P. Vidal, "Detonation diffraction from circular tubes to cones". *Shock Waves* 14(2005) 187-192)): The same phenomena were observed in experiments with divergent channels. This weakening effect is not always obvious in the simulations due to the irregularity of the cell structure, but it does weaken the detonation front. By the time the detonation front reaches the tip of the first wedge 102, the upper part of the detonation front weakens to the point where the flame 106 decouples from the shock 108 (see FIG. 1A, FIG. 1B and FIG. 1C).

The interaction of the leading shock, such as the shock 108, with the sharp tip of the wedge 102, both sides of which are roughly perpendicular to the detonation front, does not produce any strong reflected shocks. Once the wedge 102 penetrates the detonation front, the two parts of the detonation front on both sides of the wedge 102 become independent of each other. The upper part continues to propagate into the pocket 104 closed above the wedge 102. Eventually, this produces a new detonation and a powerful reflected shock, but these reflected shocks never reach the lower part of the detonation front. The lower part of the detonation front continues to propagate into the second divergent section of the consecutive divergent sawtooth section 122 geometry and gradually weakens. Due to the irregularity of the detonation front, this weakening is also irregular and non-uniform in the sense that random parts of the detonation front may become weaker or stronger at different times.

When the detonation front reaches the second wedge 102, the upper part of the detonation front is the strongest. The wedge 102 cuts the upper part from the weaker lower part, thus weakening the lower part even further. Again, the lower side of the wedge 102 is practically perpendicular to the leading shock 108 and does not create any new transverse waves in the lower part of the detonation front. The upper part of the detonation front burns all the material in the pocket 104, but this does not affect the lower part of the detonation front.

In the third divergent section of the consecutive divergent sawtooth section 122, the detonation front weakens considerably, and the flame 106 completely decouples from the shock 108. Since this is the last section of the consecutive divergent sawtooth section 122, the lower side of the last wedge 102 is horizontal and is not perpendicular to the directing shock 108. The shock 108 reflection at this side creates a MACH stem, which is too weak to ignite the material (where the MACH stem is a shock configuration that forms when an incident shock is reflected from a surface). The flame 106 which is decoupled and that propagates with the flow behind the shock 108 also reaches the tip of the wedge 102, thus separating the unburned material in the pocket 104 above the wedge 102 from the unburned material in the channel 101. When the upper part of the shock 108 above the wedge 102 reaches the end of the pocket 104 and ignites a detonation, this detonation cannot spread into the channel 101. Thus, the detonation in the channel 101 is quenched. The weakening inert shock 108 continues to propagate through the channel 101 as the distance between the flame 106 and the shock 108 increases.

FIG. 3A through FIG. 3L show the detonation propagating through the sawtooth section of the consecutive divergent sawtooth section 122 in the opposite direction. In the channels represented by FIG. 2A through FIG. 2L and FIG. 3A through FIG. 3L, temperatures can reach between 300 degrees Kelvin (K) and 3000K. In this case, the detonation survives. Even though the diffraction at each wedge considerably weakens the detonation front, subsequent shock collisions with oblique walls that form convergent sections create powerful transverse waves. These powerful transverse waves help the detonation propagation (see FIG. 3D) or reignite it (see FIG. 3G). As a result, the detonation exiting the sawtooth section from the anterior end is as healthy as the one entering it from the posterior end.

Referring to FIG. 1B, FIG. 1C, FIG. 4A, FIG. 4B, FIG. 4C, FIG. 5A, FIG. 5B and FIG. 6, channel geometries which promote detonation propagation only in one direction and which do not create flow restrictions in a channel such as channel 101, channel 401, channel 501 an channel 601, respectively, have been described. In one direction, the detonation quenching is achieved using consecutive divergent sawtooth section(s) 122 to weaken the detonation front through the detonation diffraction. The detonation reignition is suppressed by wedge(s) 102, which isolate reignition centers from the main detonation front. In another (i.e., an opposite) direction, the detonation propagation is supported by convergent walls.

Referring to FIG. 1A, FIG. 1B, FIG. 5A and FIG. 5B, according to S. M. Folga *Natural Gas Pipeline Technology Overview*, (November 2007), ANL/EVS/TM/08-5, Argonne National Laboratory, p. 2, Pipelines can measure anywhere from 6 to 48 inches (15.2 cm to 121.9 cm) in diameter (D) 520, although certain component pipe sections can consist of small-diameter pipe that is as small as 0.5 inch (1.3 cm) in diameter (D) 520. And, according to natgas.info: The independent natural gas information site "Gas Pipelines: In-Field Transport", The Internet, accessed Sep. 20, 2011 [http://www.natgas.info/html/gaspipelines.html] p. 1, the maximum diameter of pipelines continues to increase every few years. As diameters of 48 in. (121 cm) become common, the industry may be approaching the practical limit to onshore pipelines. To handle the increasing demand, it is likely that operating pressures will increase rather than the size of the pipe.

Referring to FIG. 1A, FIG. 1B, FIG. 5A and FIG. 5B, the geometry described herein is optimized using an extensive series of numerical simulations in which the sizes and angles of the sawteeth were varied (see FIG. 1A and FIG. 1B referring to an angle (alpha) $\alpha$ 114 of the leading wall of the pocket 104 to the channel 101 and to an angle (beta) $\beta$ 116 an angle opposite of the angle $\alpha$ 114; and the angle (beta) $\beta$ 116, also the angle of the trailing wall of the last pocket 104 to the channel 101) in the consecutive divergent sawtooth section(s) 122. The angle $\alpha$ 114 can have a value that ranges from about 14 degrees up to about 20 degrees. The angle $\beta$ 116 can have a value that ranges from about 27 degrees up to about 30 degrees. The value for H can be either the height and/or the diameter (D) 520 of the channel, such as channel 101 and/or channel 501 respectively (see FIG. 5A and FIG. 5B), while h is the distance from the surface of the channel to the top of the pocket 104 of the channel geometry, such as the channel geometry 100. L is the length of the opening of the pocket 104, as formed in the channel, such as channel 101 of the channel geometry 100, see FIG. 1B. In addition, W can be either the width and/or the diameter (D) 520 of the channel, such as the channel 101 of FIG. 1B or the channel 501 respectively, see FIG. 5A and FIG. 5B. Simulations were performed for one particular reactive system, described by a simplified reaction model that approximates a stoichiometric hydrogen-air mixture and produces a realistic irregular detonation cell structure typical of many practical fuel-air mixtures. It follows, that the same type of geometry and/or geometries will serve to quench detonations in other mixtures as well, although optimum geometrical parameters may be different.

Figure 5A:
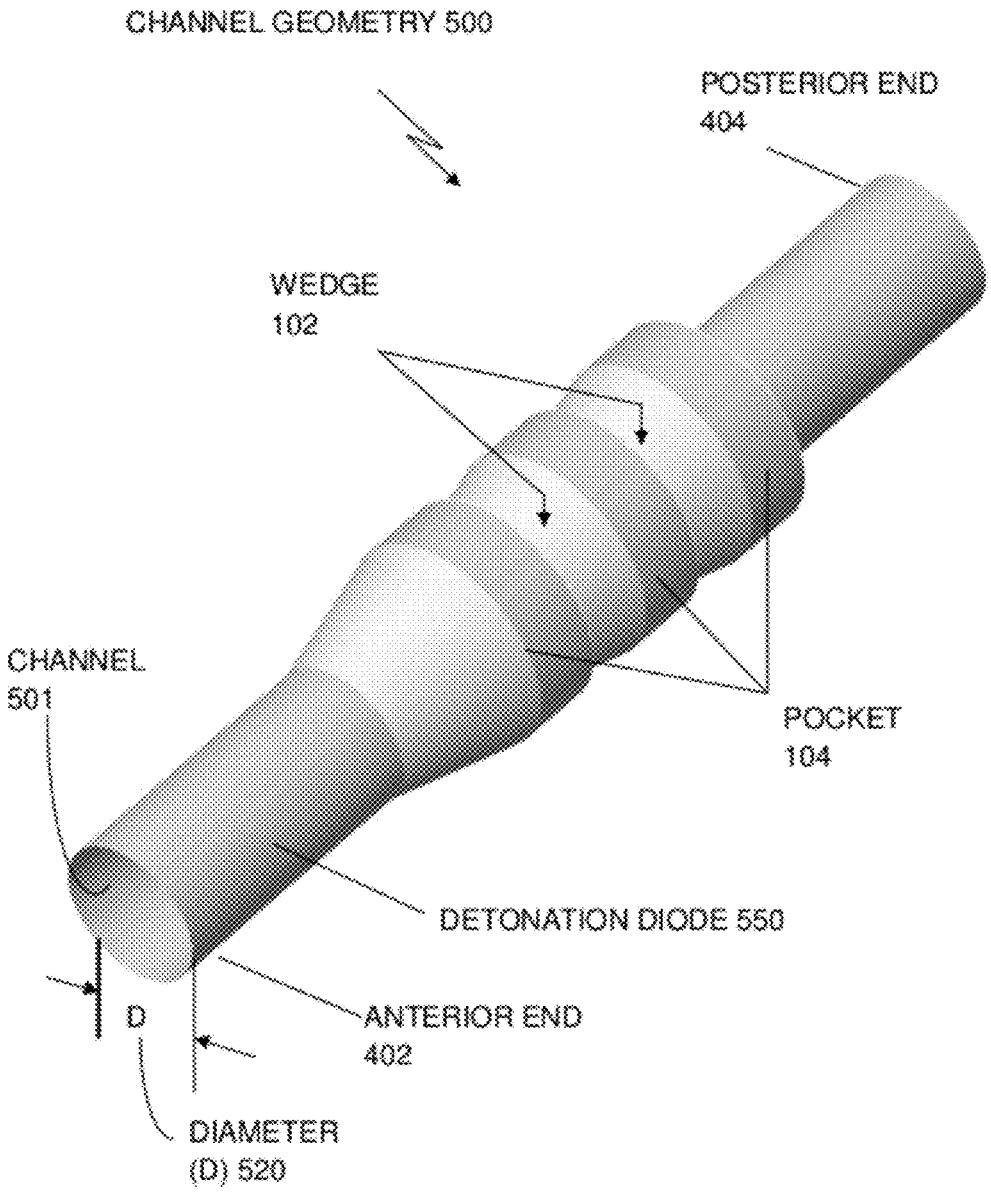
FIG. 5A illustrates a 3D anterior view of channel geometry 500 and detonation diode 550, where the channel 501 is a cylindrical tube type channel, having a consecutive divergent sawtooth section 122, i.e., a sawtooth geometry formed as part of the channel 501, which conforms to the specifications of the 2D cross-section view of upper half channel geometry 100 illustrated in FIG. 1A (therefore, the channel diameter (D) 520 of channel 501 typically can range from about 0.4 inches (1 cm) to about 50 inches (127 cm)).
Figure 5B:
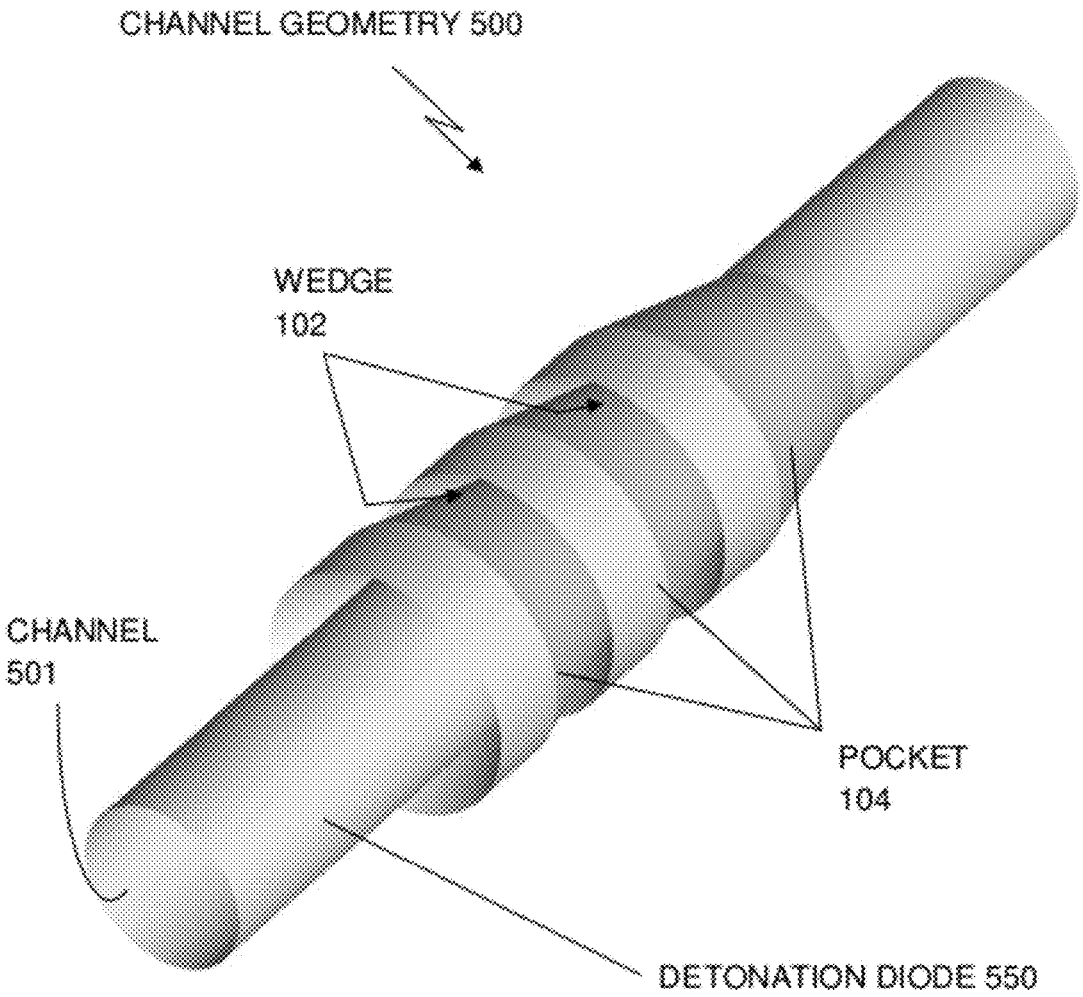
FIG. 5B illustrates a 3D posterior view of channel geometry 500 and detonation diode 550.

Referring to FIG. 1A, FIG. 1B, and FIG. 5A, the ratio of H to h is approximately 2. Also, the ratio of L to H is approximately 2. A given detonation cell size depends on a particular gaseous mixture and for practical systems can vary from fractions of millimeters to meters. The channel height H should be smaller than 13 detonation cells (in larger channels, it is more difficult to stop detonation by diffraction when the detonation front is traveling from a smaller channel to a larger channel). Values for angles α 114 and β 116 will not change very much.

Referring to FIG. 3A through FIG. 3L, since convergent sawtooth geometries promote the detonation propagation in a channel, the same effect created by similar convergent geometries can also facilitate the detonation transition from a small channel to a larger channel. When installed in the transitional section between a small channel and a large channel, these geometries will create shock reflections and powerful transverse waves that help the detonation propagation. For these reasons, the survival of a detonation exiting a small channel and propagating through a transitional expanding sawtooth section into a larger channel is more likely than without the sawtooth section.

Again referring to FIG. 1A, FIG. 1B, FIG. 5A and FIG. 5B, corresponding to varying pipe sizes, W can have any value, but typically W has a value in a range from between about 2.5 inches (6.4 cm) up to about 25 inches (63.5 cm). Height H also can have any value and typically can range from about 0.2 inches (0.5 cm) up to about 25 inches (63.5 cm). The cross-section and upper half values translate into typical channel sizes where values range from about 5 inches (12.7 cm) to about 50 inches (127 cm) for W and from about 0.4 inches (1 cm) to about 50 inches (127 cm) for H.

The stochastic behavior of detonations with irregular cell structures means that for each simulation and/or experiment, detonation diffraction occurs in a slightly different way. Thus different numbers of sections may be required to quench the detonation. Increasing the number of sections usually helps, but too many sections may lead to the flame acceleration and DDT similar to that observed in channels with obstacles as discussed in V. N. Gamezo, T. Ogawa, E. S. Oran. "Flame Acceleration and DDT in Channels with Obstacles: Effect of Obstacle Spacing". *Combust. Flame* 155 (2008) 302-315

Figure 4A:
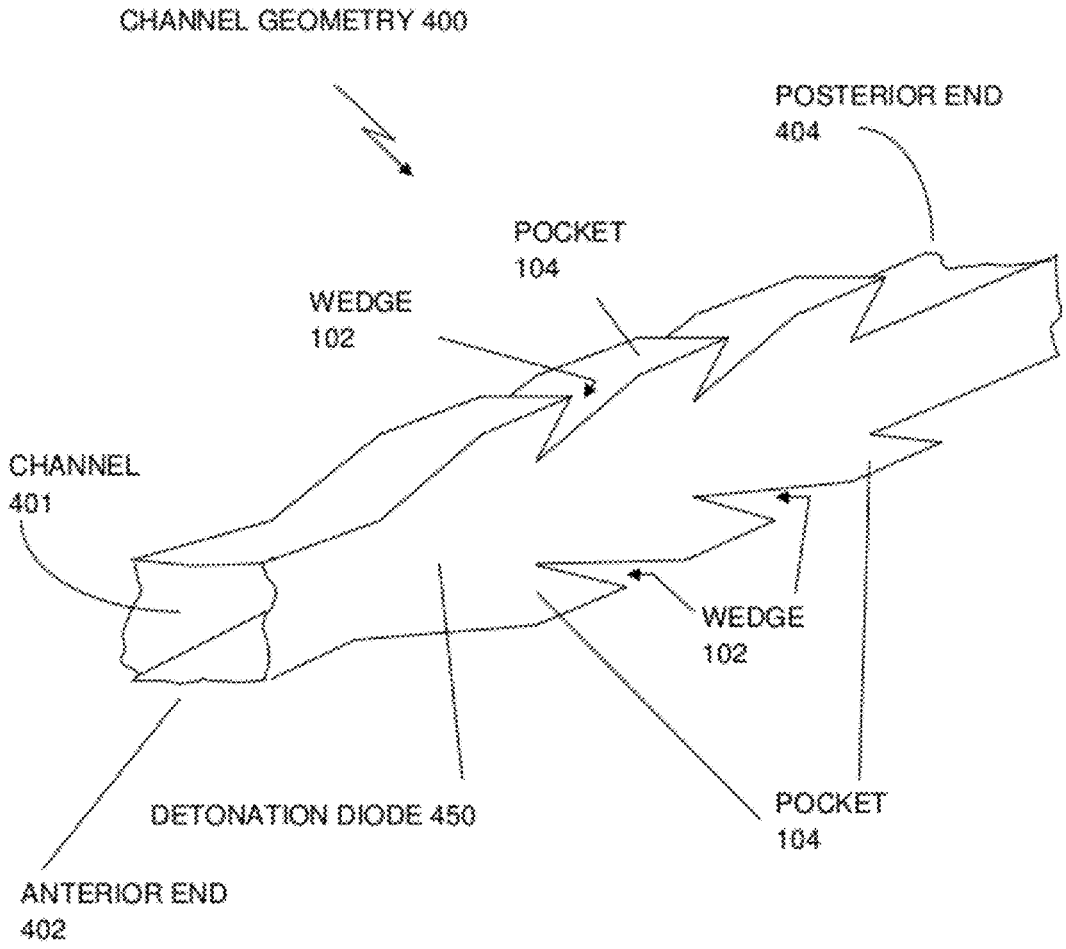
FIG. 4A illustrates a 3D cross-section view of channel geometry 400 of a detonation diode 450, where the channel 401 can be either rectangular or square and has consecutive divergent sawtooth section(s) 122, i.e., sawtooth geometries on at least two surfaces (however, the channel 401 may have a plurality of consecutive divergent sawtooth sections 122, i.e., sawtooth geometries on one or more or all surfaces—see FIG. 4B and FIG. 4C).
Figure 4B:
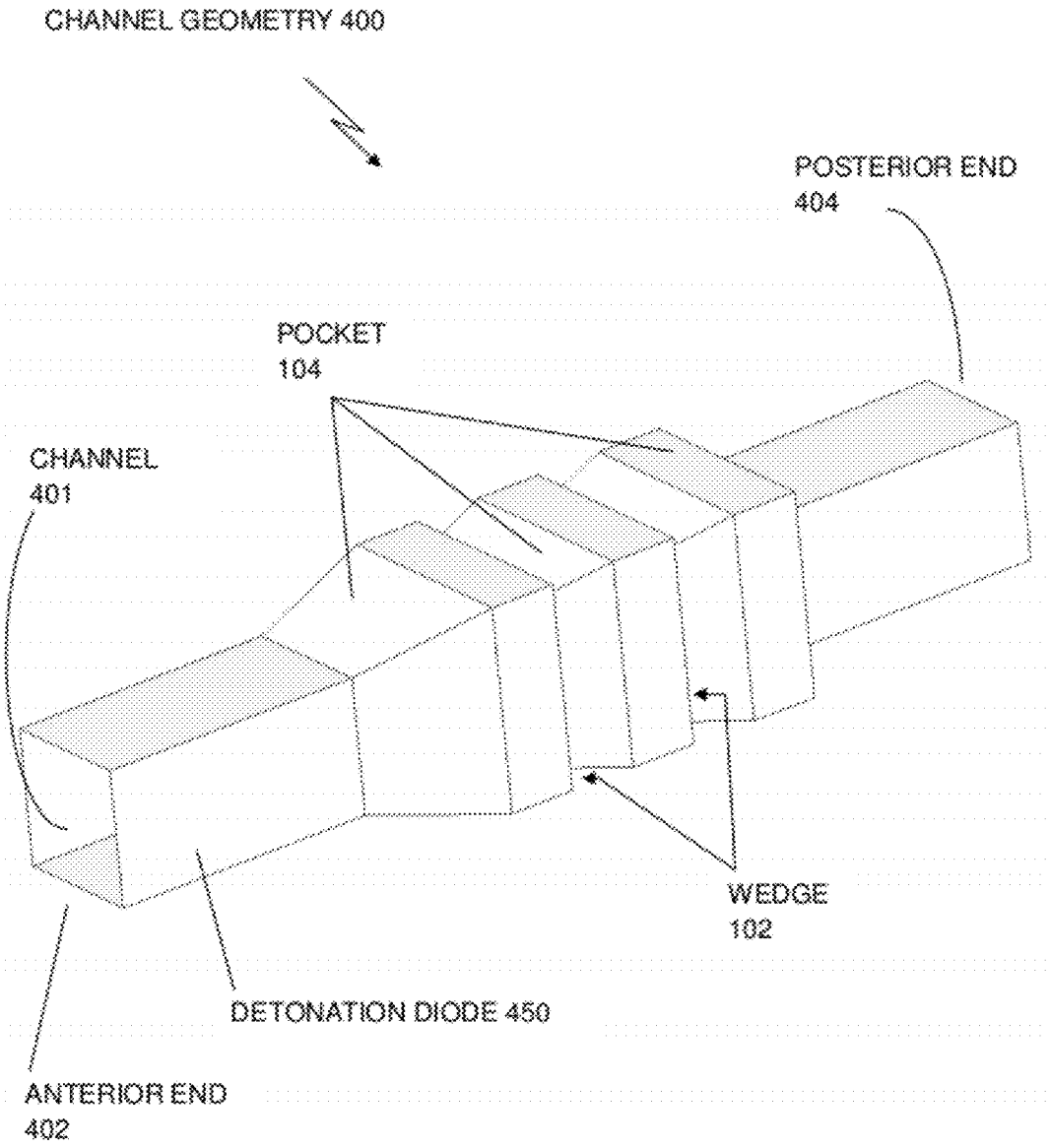
FIG. 4B is a 3D anterior view of the detonation diode 450.
Figure 4C:
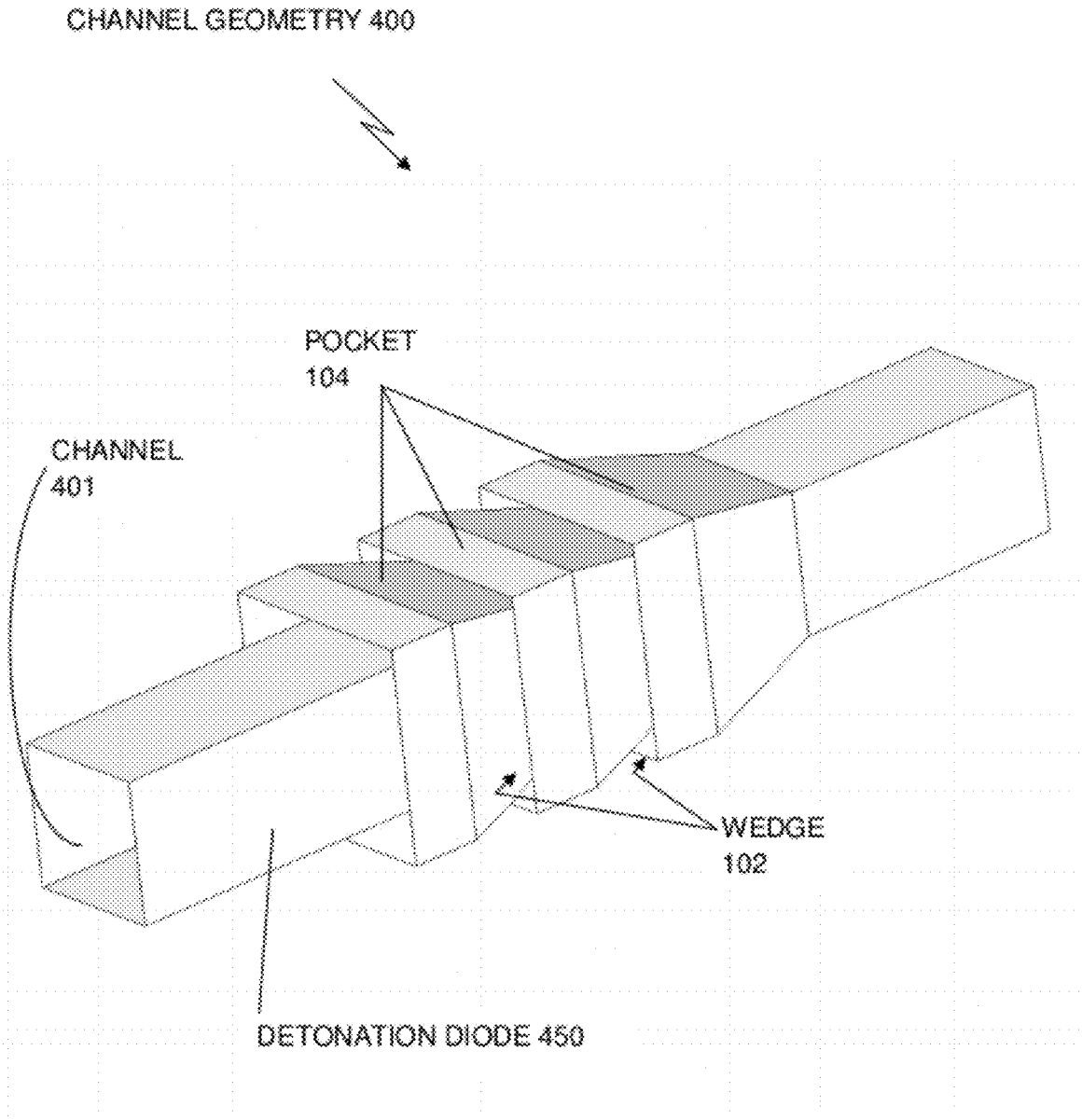
FIG. 4C is a 3D posterior view of the detonation diode 450.
Figure 7:
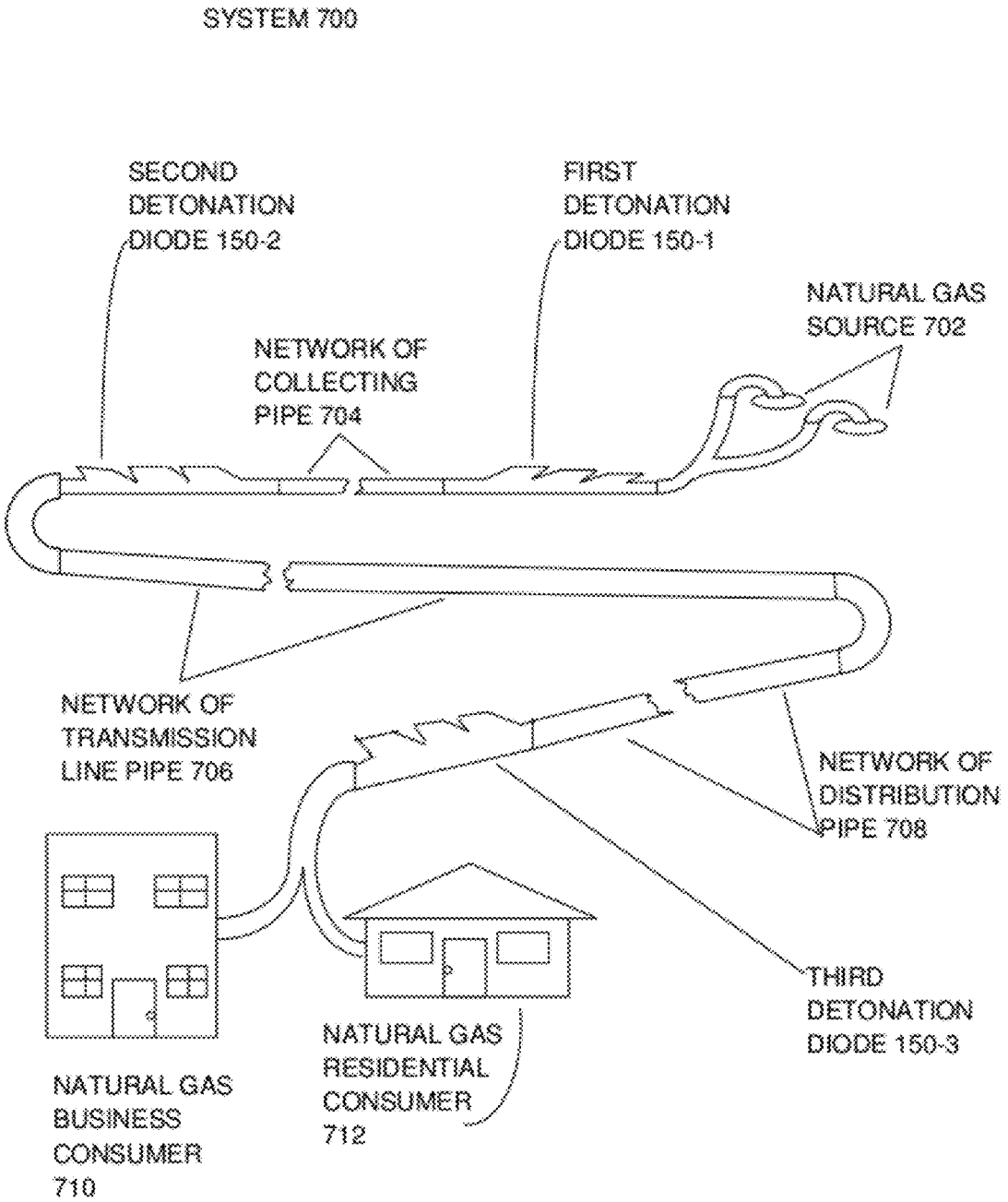
FIG. 7 illustrates a system of gaseous mixture collecting, transmission and distribution networks including detonation diodes.

According to a first exemplary embodiment, and referring to FIG. 4B (also see FIG. 4A which is a cross-section view of FIG. 4B) and FIG. 7, a gaseous mixture flow apparatus, that promotes a detonation propagation of a plurality of gaseous mixtures in one direction and suppresses the detonation propagation of the plurality of gaseous mixtures in an opposite direction, is composed of a detonation diode 450 including a channel 401 having a first end also referred to as a posterior end of the channel 401 having a first opening, wherein a plurality of gaseous mixture flows enters the channel 401. Further, the detonation diode 450 includes a second end also referred to as a posterior end of the channel 401 having a second opening where the plurality of gaseous mixture flows exits the channel 401. In addition, the detonation diode 450 includes a plurality of surfaces. According to this first exemplary embodiment, the plurality of surfaces includes at least a first surface, a second surface, a third surface and a fourth surface of the plurality of surfaces and each of the first, second, third, and fourth surfaces has an at least three consecutive divergent sections formed as a sawtooth shape geometry (where the first surface is a top surface, the third surface is a bottom surface and the second and fourth surfaces are side surfaces of the channel 401), and where the at least three consecutive divergent sections are formed on each of the first, second, third, and fourth surfaces and are separated by a plurality of wedges 102 (where the plurality of wedges 102 includes at least two wedges 102, but can have more than two wedges 102). Further, the at least three consecutive divergent sections includes a plurality of pockets 104 (where the plurality of pockets 104 includes at least three pockets 104, but can have more than three pockets 104) having a plurality of angled walls formed in the at least first surface of the channel 401 as the sawtooth shape geometry thus, the sawtooth shape geometry is formed on all four surfaces forming a circumference of sawtooth shape geometries of the detonation diode 450. Because of the plurality of pockets 104 formed in the sawtooth shape geometry, the sawtooth shape geometry causes suppression of any detonation of the gaseous mixture flow in the detonation diode 450; thus, the gaseous mixture flow fails to propagate through the sawtooth shape geometry in a first direction in the channel 401 (where the first direction is a direction from the anterior end towards the posterior end of the channel 401. Furthermore, the sawtooth shape geometry propagates the detonation of the gaseous mixture flow in a second direction in the channel 401, where the second direction is a direction from the posterior end of the channel 401 towards the anterior end of the channel 401; this propagation results because the detonation front is weakened by diffraction, and reignition centers are isolated from the main channel 401. Furthermore, the detonation diode 450 (also see detonation diodes 150-1, 150-2 and 150-3 in FIG. 7) is free from obstruction restriction in either the operation of collection, transmission and/or distribution of the plurality of gaseous mixture flows in a natural gas collection, transmission and distribution system, such as system 700 (see FIG. 7).

The detonation diode is composed of various thicknesses of either metal or advanced plastics. The metal includes but is not limited to steel and carbon steel, but other metals and metal compounds, as well as various compounds of advanced plastics can be used, which are suitable for gaseous mixture flow under high pressures and high temperatures.

Further according to the first exemplary embodiment and referring to FIG. 1B and FIG. 4B, the detonation diode 450 will operate with any width W 120.

Further according to the first exemplary embodiment and referring to FIG. 1B and FIG. 4B, a leading wall of each pocket in the detonation diode forms an angle alpha (α) 114 with the surface of the channel, wherein α 114 has a value in a range from about 14 degrees to about 20 degrees.

Further according to the first exemplary embodiment and referring to FIG. 1B and FIG. 4B, a trailing wall of each pocket 104 in the detonation diode forms an angle beta (β)

116 with the surface of the channel, wherein β 116 has a value in a range from about 27 degrees to about 30 degrees.

Further according to the first exemplary embodiment and referring to FIG. 1B and FIG. 4B, the channel includes any height H from the at least first surface of the channel 401 to the at least third surface of the channel, and wherein the channel includes a height h having a value in a range of about 0.5 cm to about 1 cm from the first surface of the channel to a top surface of each pocket 104 of the sawtooth shape geometry formed in the channel.

Further according to the first exemplary embodiment and referring to FIG. 1B and FIG. 5A, where the channel 501 is a circular pipe channel including any diameter (D) 520, where the plurality of pockets 104 includes a first pocket 104, a second pocket 104 and a third pocket 104 of the plurality of pockets 104 formed in a surface of the circular pipe and circumnavigating the circular pipe forming the sawtooth shape, and where a length of an opening of each pocket 104 in the sawtooth shape is 2 cm.

Figure 5C:
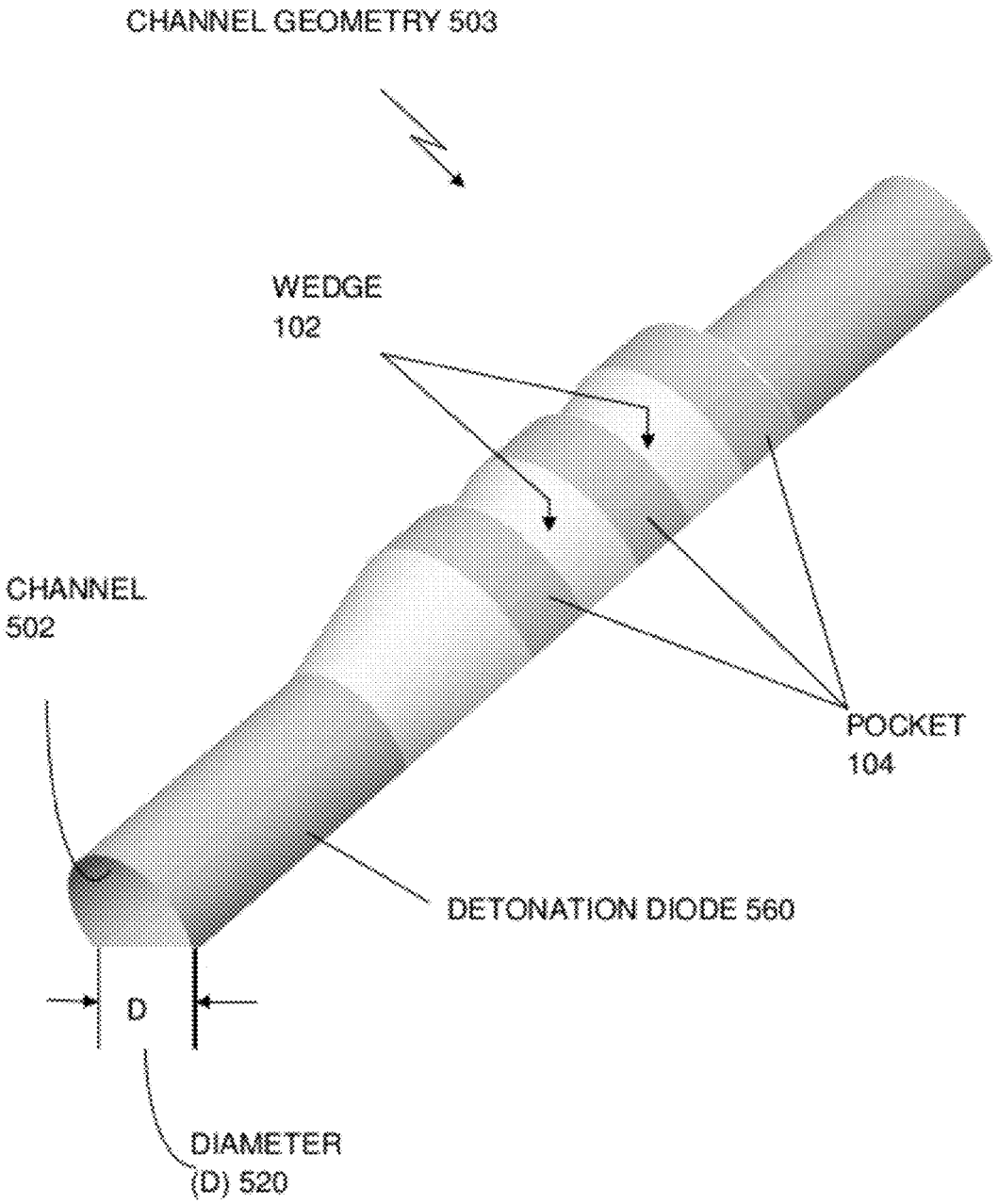
FIG. 5C illustrates a 3D anterior view of channel geometry 503 and detonation diode 560.
Figure 6:
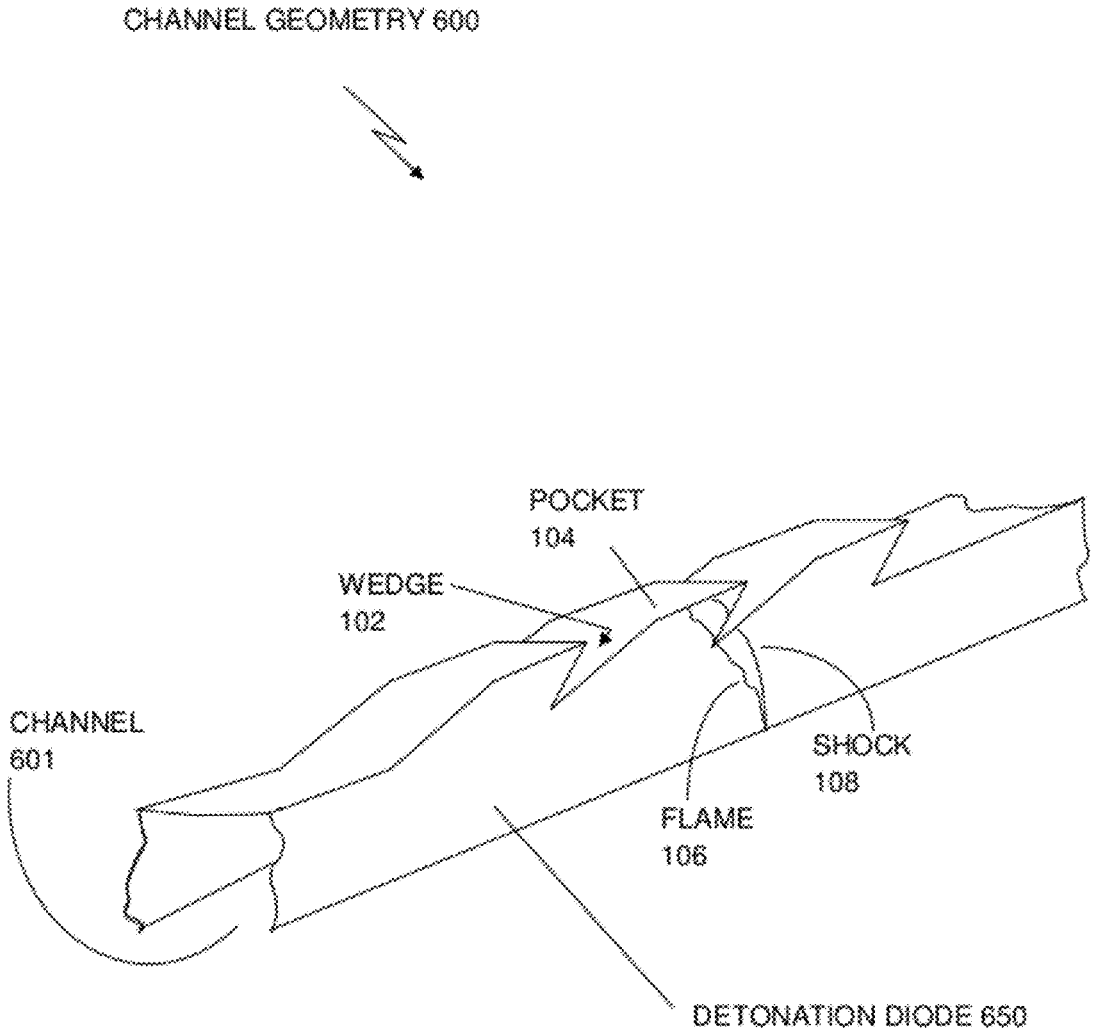
FIG. 6 illustrates a 3D view of channel geometry 600, where the channel 601 is a half pipe rectangular channel 601 having at least one consecutive divergent sawtooth section 122, i.e., a sawtooth geometry on at least one surface of the channel.

Further according to the first exemplary embodiment and referring to FIG. 1B, FIG. 5C and FIG. 6 where the channel is one of a half pipe circular channel 502 and a half rectangular channel respectively, where the half pipe circular channel 502 includes any diameter D 520, where the half rectangular channel 601 includes a top surface and two side surfaces, where the plurality of pockets 104 includes a first pocket 104, a second pocket 104 and a third pocket 104 of the plurality of pockets 104 formed in either a surface of the half pipe circular channel 502 as the sawtooth shape or the top surface of the half rectangular channel 601, and wherein a length of an opening of each pocket 104 in the sawtooth shape is 2 cm.

FIG. 6 illustrates a 3D view of channel geometry 600, where the channel 601 is a half pipe rectangular channel 601 having at least one consecutive divergent sawtooth section 122, i.e., a sawtooth geometry on at least one surface of the channel. As illustrated in FIG. 1B, FIG. 1C, FIG. 4B, FIG. 5A, FIG. 5C and FIG. 6, the channel(s), such as channel 101, channel 401, channel 501, channel 502 and channel 601 can be rectangular, square, circular, half pipe or full pipe; furthermore, such channels, can also be triangular and/or any regular and/or irregular volumetric shape and/or form, including pyramid, conical, and/or trapezoidal shapes.

Figure 8A:
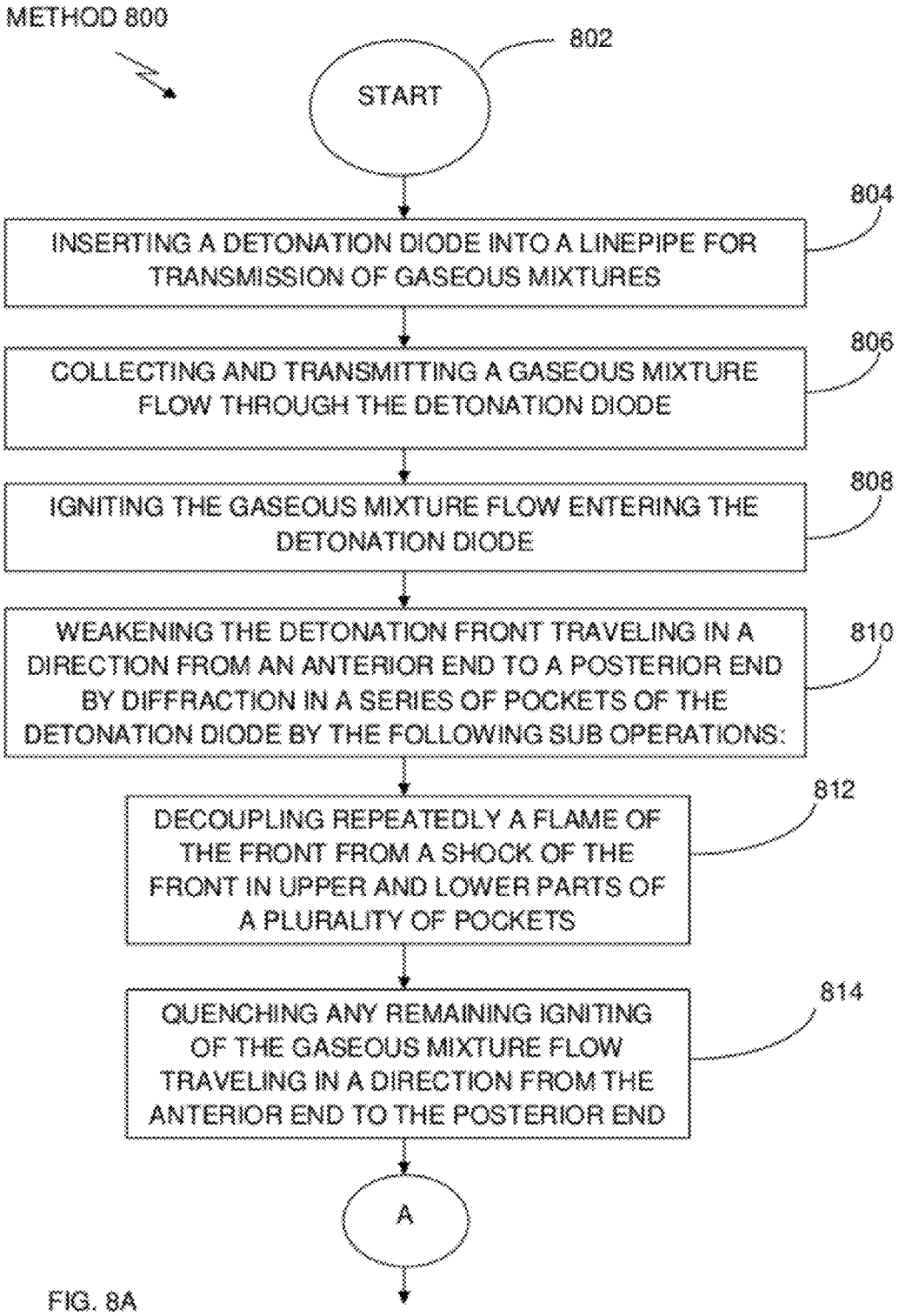
FIG. 8A illustrates a method of suppressing a detonation front in one direction of a detonation diode.

According to a second exemplary embodiment and referring to FIG. 8A, FIG. 8B, FIG. 4B and FIG. 5A, at an operation start 802 the method 800 initiates an operation of suppressing detonation propagation in a first direction and promoting detonation propagation in a second direction in a gaseous mixture flow channel, such as channel 401 having a sawtooth geometry, wherein the gaseous mixture flow channel 401 is a detonation diode, such as detonation diode 450. The operations of method 800 comprise:

Further according to the second exemplary embodiment, referring to FIG. 4B, FIG. 6, and FIG. 8A, at an operation 804, inserting the detonation diode 450 in the gaseous mixture flow channel, such as channel 401, using a plurality of couplings. The detonation diode 450 includes a plurality of angled walls and a plurality of wedges in the sawtooth geometry formed as a series of pockets inside of the detonation diode.

Further according to the second exemplary embodiment, referring to FIG. 1B, FIG. 4B, FIG. 6, and FIG. 8A, at an operation 806, method 800 performs operations of collecting and transmitting a gaseous mixture flow through an opening of a first end of the detonation diode 450, such as the anterior end 402, where the first end (anterior end 402) of the detonation diode 450 is facing a plurality of sharp tips (see FIG. 1B) of the plurality of wedges 102, inside of the detonation diode 450 (and see FIG. 1B), forming the sawtooth geometry.

Further according to the second exemplary embodiment, again referring to FIG. 1B, FIG. 4B, FIG. 6 and FIG. 8A, at an operation 808, igniting, in an initial ignition, the gaseous mixture flow entering the detonation diode 450, further causing a detonation front traveling through the detonation diode 450 from an anterior end 402 toward a posterior end 404 of the detonation diode 450 in a direction away from the initial ignition.

Again according to the second exemplary embodiment, and referring to FIG. 1B, FIG. 4B, and FIG. 8A, at an operation 810, the method 800 operates to weaken the detonation front by causing diffraction of the detonation front in the plurality of angled walls and the plurality of wedges 102 in the sawtooth geometry formed as the series of pockets 104 of the detonation diode 450, by operation of the following sub operations:

Further according to the second exemplary embodiment, and referring to FIG. 1B, FIG. 4B, and FIG. 8A, at an operation 812, the method 800 operates to decouple the flame 106 of the detonation front from the shock 108 of the detonation front, when the detonation front reaches a first tip of the plurality of sharp tips of a first wedge 102 in the sawtooth geometry, causing a first upper part of the detonation front to weaken in a first pocket 104 of the series of pockets 104 to a point where decoupling the flame 106 of the detonation front from the shock 108 of the detonation front occurs; and as the detonation front travels through the detonation diode 450 from the anterior end 402 toward the posterior end 404 of the detonation diode 450 in the direction away from the initial ignition.

Further according to the second exemplary embodiment, referring to FIG. 1B, FIG. 4B, and FIG. 8A, and according to the sub operation 812, when a first lower part of the detonation front continues to propagate reaching a second tip of a second wedge 102 in the sawtooth geometry, a second upper part of the detonation front weakens in a second pocket 104 of the series of pockets 104 to a point where further decoupling of the flame 106 of the detonation front from the shock 108 of the detonation front occurs, as the detonation front travels through the detonation diode 450 from the anterior end 402 toward the posterior end 404 of the detonation diode 450 in the direction away from the initial ignition.

Further according to the second exemplary embodiment, referring to FIG. 1B, FIG. 4B, FIG. 7, and FIG. 8A, and according to the sub operation 814, when a second lower part of the detonation front continues to propagate reaching a third tip of a third wedge 102 in the sawtooth geometry, a third upper part of the detonation front weakens in a third pocket 104 of the series of pockets 104 to a point where complete decoupling of the flame 106 of the detonation front from the shock 108 of the detonation front occurs, quenching any remaining igniting of the gaseous mixture flow and preventing further detonation from traveling through the detonation diode 450 from the anterior end 402 toward the posterior end 404 of the detonation diode 450 in a direction away from the initial ignition; and where preventing further detonation from traveling through the detonation diode 450 prevents detonation of the gaseous mixture in the gaseous mixture flow channel 401 from causing catastrophic damage to human, structural and mechanical assets proximate to the gaseous mixture flow channel (see FIG. 7). FIG. 7 illustrates a system of gaseous mixture collecting, transmission and distribution networks including detonation diodes.

FIG. 8A illustrates a method of suppressing a detonation front in one direction of a detonation diode.

Figure 8B:
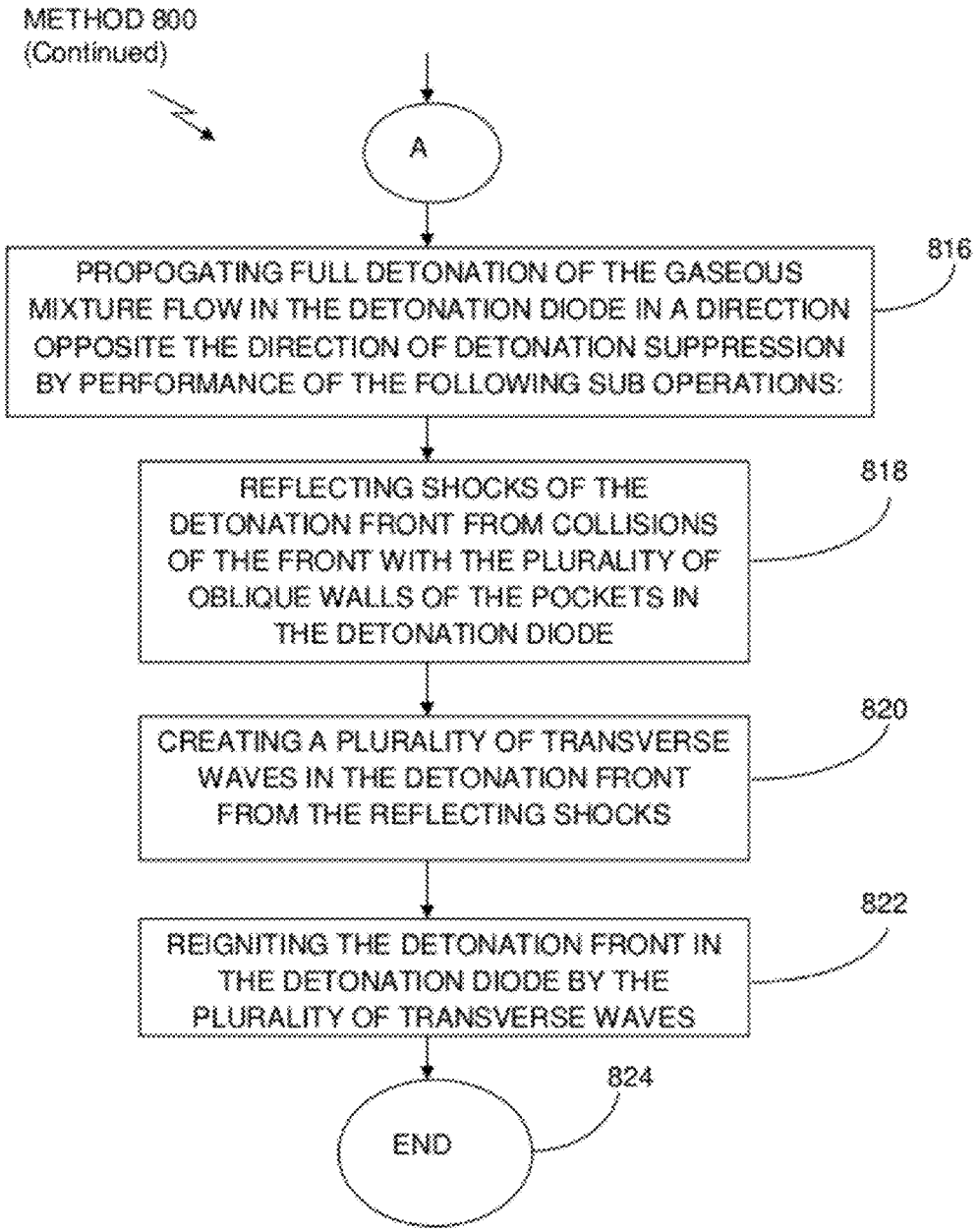
FIG. 8B illustrates a method of promoting the detonation front in an opposite direction of the detonation diode.

FIG. 8B illustrates a method of promoting the detonation front in an opposite direction of the detonation diode.

Further, according to the second exemplary embodiment, referring to FIG. 1B, FIG. 4B, FIG. 8A, and FIG. 8B, and according to operation 814, the method 800 continues from FIG. 8A as indicated by the transition/continuation symbol of an encircled "A" in FIG. 8A to the encircled "A" shown in FIG. 8B, where the method 800 in operation 816 causes propagating, in the detonation diode 450, full detonation of the gaseous mixture flow in a direction opposite of the direction of suppressed detonation as illustrated in FIG. 8A by performance of the following sub operations:

Further according to the second exemplary embodiment, further referring to FIG. 1B, FIG. 4B, FIG. 8A and FIG. 8B, and according to the sub operation 818, the method 800 via sub operation 818 causes reflection of shocks 108 of the detonation front from collisions of the detonation front with a plurality of oblique walls of the plurality of pockets 104 inside of the detonation diode 450 forming the sawtooth geometry According to sub operation 820 creating a plurality of transverse waves in the detonation front from the reflecting shocks 108.

Further according to the second exemplary embodiment, referring to FIG. 1B, FIG. 4B, FIG. 8A and FIG. 8B, the method 800 continues at the sub operation 822 reigniting the detonation front by the plurality of transverse waves created from reflecting shocks of the detonation front from the plurality of oblique walls of the plurality of pockets 104, wherein the detonation diode is free of obstruction restricting the gaseous mixture flow in the gaseous mixture flow channel 401, and wherein the direction opposite of the direction of suppressed detonation is a constructed section of the gaseous mixture flow channel 401 either accepting or using full detonation of the detonation front free of catastrophic damage in a detonation reception chamber.

According to a third exemplary embodiment, referring to FIG. 7, a system 700 is a gaseous mixture transmission system that promotes a detonation propagation of a plurality of gaseous mixtures in one direction and suppresses the detonation propagation of the plurality of gaseous mixtures in an opposite direction. The system comprises a gaseous mixture source, such as the natural gas source 702 from which the plurality of gaseous mixtures is produced, collected, transmitted and distributed.

Figure 1C:
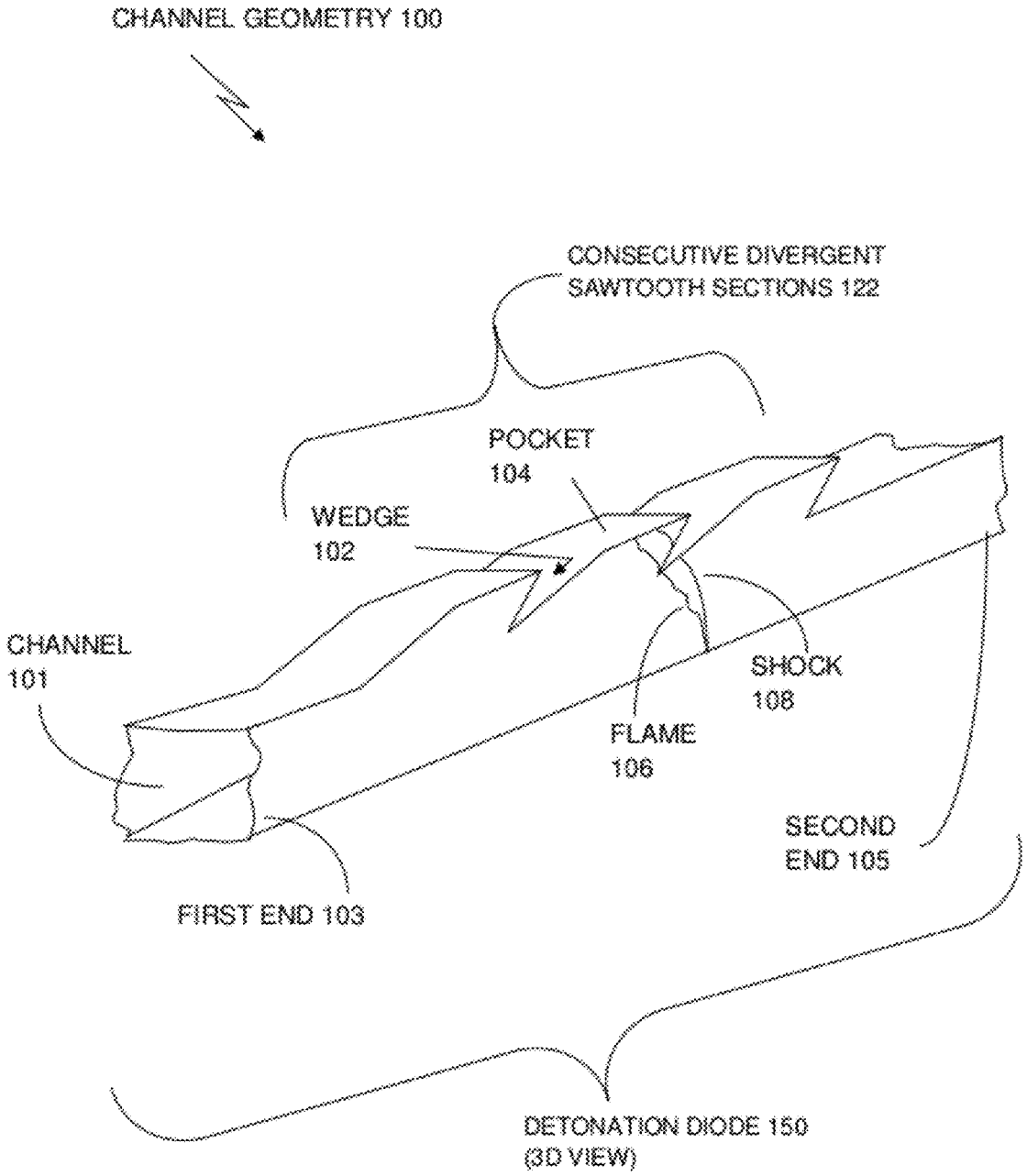
FIG. 1C illustrates the 3D cross-section view of the upper half channel geometry 100 without the measurement detail, where the channel 101 can be either rectangular or square.
Figures 2A, 2B, 2C, 2D, 2E, 2F:
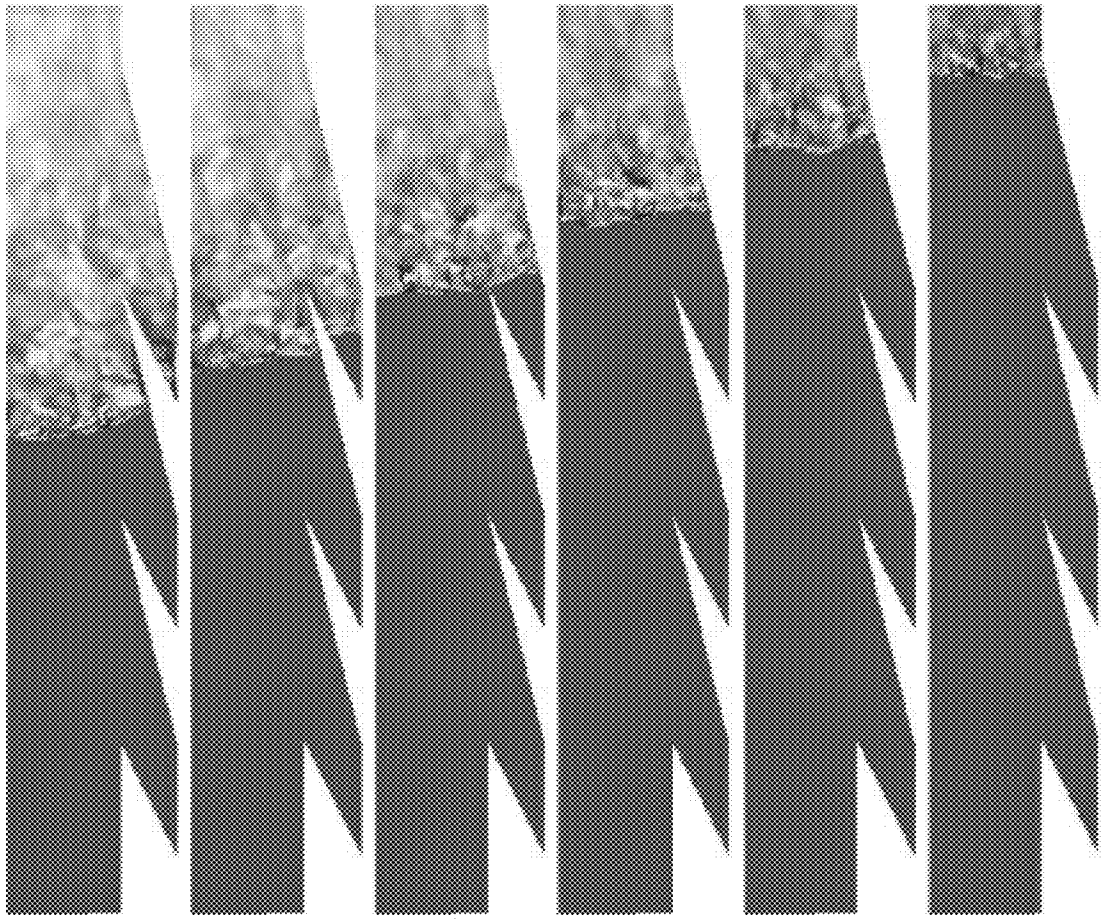
FIG. 2A through FIG. 2L illustrate detonation propagation through sawtooth geometry.
Figure 2G:
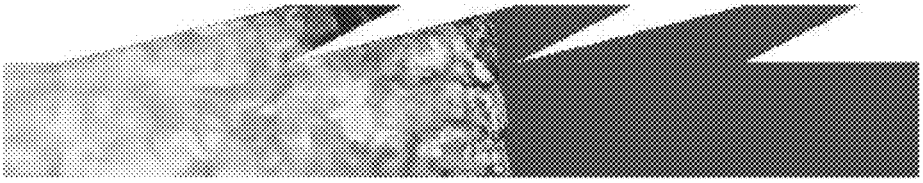
Figure 2H:
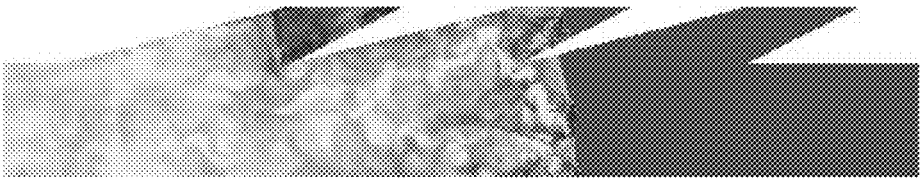
Figure 2I:
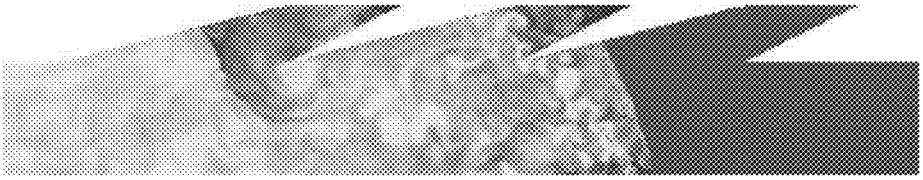
Figure 2J:
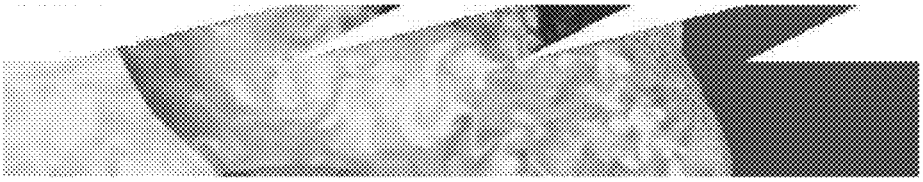
Figure 2K:
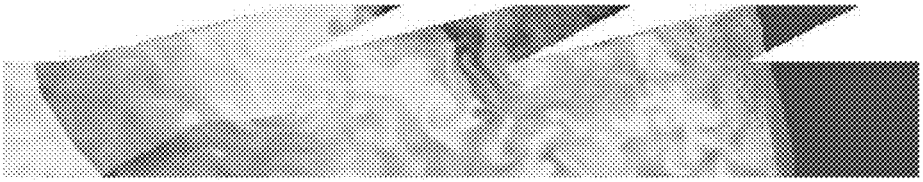
Figure 2L:
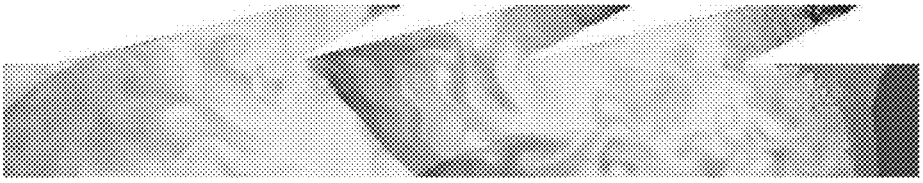
Figures 3A, 3B, 3C, 3D, 3E, 3F:
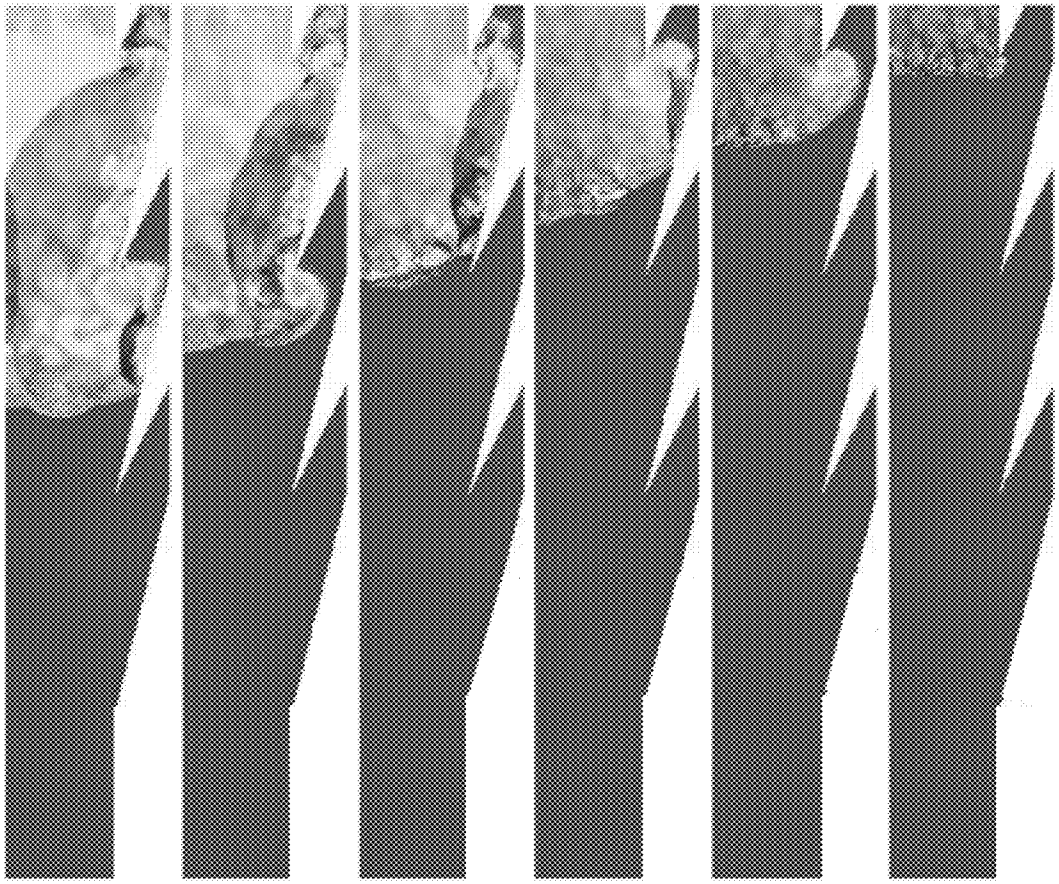
FIG. 3A through FIG. 3L illustrate detonation propagation through sawtooth geometry in an opposite direction of that illustrated in FIG. 2A through FIG. 2L.
Figure 3G:
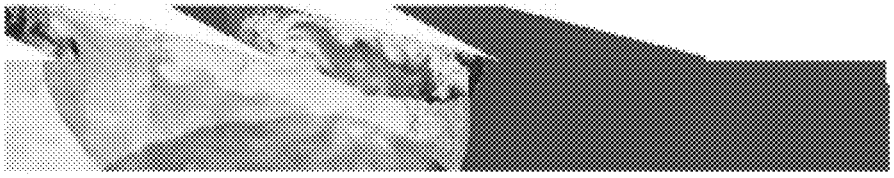
Figure 3H:
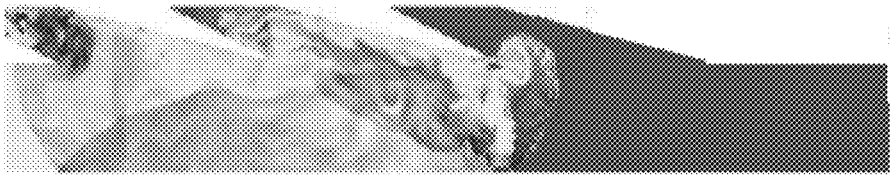
Figure 3I:
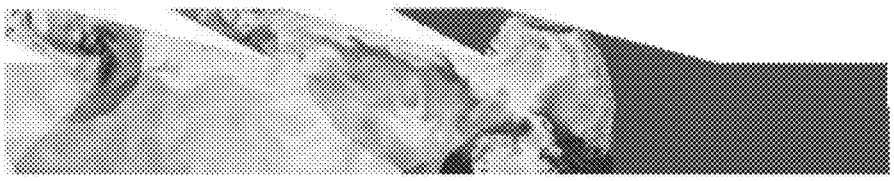
Figure 3J:
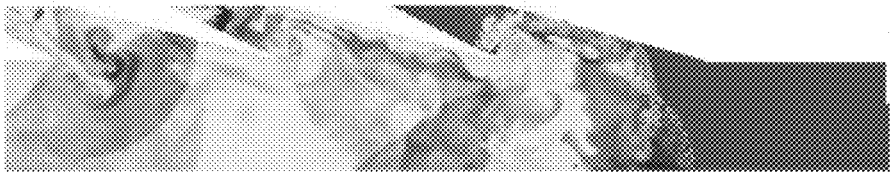
Figure 3K:
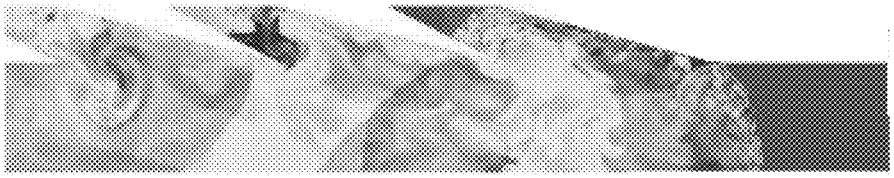
Figure 3L:
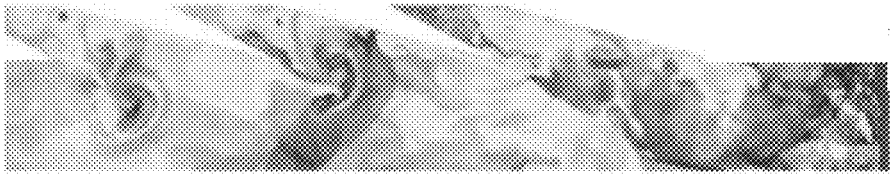

Further according to the third exemplary embodiment, referring to FIG. 1B, FIG. 1C and FIG. 7, the system 700 comprises a network of collecting pipe 704, which is used to collect the plurality of gaseous mixtures, and the network of collecting pipe 704 is connected to the gaseous mixture source at a first coupling connection. A first detonation diode such as first detonation diode 150-1 connected between the gaseous mixture source, such as the natural gas source 702 and the network of collecting pipe 704 by way of the first coupling connection, where the first detonation diode 150-1 is positioned in line with the network of collecting pipe 704 and the first coupling connection in a manner that causes suppression of the detonation propagation of the plurality of gaseous mixtures from traveling in a direction towards the gaseous mixture source, such as having the second end 105 (see FIG. 1C) of the detonation diode 150-1 positioned closest to the natural gas source 702 and the first end 103 of the detonation diode 150-1 is positioned farthest away from the natural gas source 702. Furthermore, the first detonation diode 150-1 is free from restriction in an operation of collection of the plurality of gaseous mixtures.

Further according to the third exemplary embodiment, referring to FIG. 1B, FIG. 1C and FIG. 7, the system 700 comprises a network of transmission line pipe 706 which transmits the plurality of gaseous mixtures, wherein the network of transmission line pipe 706 is connected to the network of collecting pipe 704 at a second coupling connection; and a second detonation diode 150-2 is connected between the network of collecting pipe 704 and the network of transmission line pipe 706 by way of the second coupling connection, where the second detonation diode 150-1 is positioned in line with the network of transmission line pipe 706 with the second end 105 (see FIG. 1C) connected to the second coupling connection, connected to the network of transmission line pipe 706 and with the first end 103 (see FIG. 1C) of the detonation diode 150-2 connected to the network of collecting pipe 704 via a coupling, in a manner that causes suppression of the detonation propagation of the plurality of gaseous mixtures from traveling in a direction of transmission of the plurality of gaseous mixtures. Also, the second detonation diode 150-2 is free from restriction of transmission of the plurality of gaseous mixtures.

Further according to the third exemplary embodiment, referring again to FIG. 1B, FIG. 1C and FIG. 7, the system 700 further comprises a network of distribution pipe 708, which is used to distribute the plurality of gaseous mixtures to consumers of the gaseous mixture, such as natural gas residential consumer 712 and natural gas business consumer 710. The network of distribution pipe 708 is connected to the network of transmission line pipe 706 at a third coupling connection; and a third detonation diode 150-3 is connected between the network of transmission line pipe 706 and the network of distribution pipe 708 by way of the third coupling connection. The third detonation diode 150-3 is positioned in line with the network of distribution pipe so that the second end 105 of the detonation diode 150-3 is closest to the gaseous mixture consumers (such as natural gas residential consumer 712 and natural gas business consumer 710) and the third coupling connection in a manner that causes suppression of the detonation propagation of the plurality gaseous mixtures from traveling in a direction of distribution towards one or more of the consumer(s) of the plurality of gaseous mixtures. Also, the third detonation diode 150-3 is free from restriction of the plurality of gaseous mixtures flow to one or more of the consumer(s), or natural gas processor(s) and/or a distributor of the plurality of gaseous mixtures. The first, second and third detonation diodes 150-1, 150-2, and 150-3 respectively each have a channel, such as channel 101 having a plurality of surfaces, wherein an at least first surface of the plurality of surfaces has an at least three consecutive divergent sections which create a sawtooth shape geometry of the first surface of the channel 101 (where the first surface of the channel 101 is the top surface of the channel 101, see FIG. 1C). Furthermore, the sawtooth shape geometry fails to propagate a detonation of the gaseous mixture in one direction in the channel while in the alternate, the sawtooth shape geometry propagates the detonation of the gaseous mixture in another direction in the channel 101.

Further according to the third exemplary embodiment, and referring to FIG. 1B, FIG. 1C and FIG. 7, in the system 700, either the network of transmission line pipe(s) 706 and/or the network of collecting pipe(s) 704 and/or the network of distribution pipe(s) 708 and/or the first, second and third detonation diodes 150-1, 150-2, and/or 150-3 respectively, are composed of either advanced plastic(s)

and/or any kind of metal and/or metal compound, such as either steel and carbon and/or a steel carbon compound.

Further according to the third exemplary embodiment, and referring to FIG. 1B, FIG. 1C and FIG. 7, in the system 700, the plurality of wedges includes at least three wedge(s) 102 (however, there can be any number of wedge(s) 102) formed by a plurality of walls and a plurality of pocket(s) 104, wherein each wedge 102 forms a wall of a next divergent section having a pocket 104 (there can be any number of pockets, however, typically there are at least three pockets included in the sawtooth shape geometry) formed in the at least first surface as the sawtooth shape geometry and as formed the sawtooth shape geometry suppresses the detonation of the gaseous mixture through the detonation diodes 150-1, 150-2 and 150-3 in the first direction (such as the direction from the first end 103 toward the second end 105 in the channel 101 (see FIG. 1C), by decoupling a flame 106 of the detonation front from a shock 108 of the detonation front in the plurality of pocket(s) 104.

Further according to the third exemplary embodiment, and referring to FIG. 1B, FIG. 1C and FIG. 7, in the system 700, the convergent parts of the sawtooth shape geometry promotes the detonation propagation by causing shock(s) 108 of the detonation front to reflect off of the plurality of walls of the pocket(s) 104 upon which the detonation front collides with and creates transverse waves, which reignite the detonation.

Further according to the third exemplary embodiment, and referring to FIG. 1B, FIG. 1C and FIG. 7, in the system 700, propagation and suppression of the detonation front by diffraction in the detonation diode(s) 150-1, 150-2, and 150-3 occur when the ratio of the channel height H to the pocket height h in the sawtooth geometry of the detonation diode(s) 150-1, 150-2, and 150-3 equals 2; this relationship is characterized as:

$$H/h=2, \tag{1}$$

where H is the channel height, where h is the pocket height; and the channel height H should be smaller than 13 detonation cells.

The detonation cell size depends on a particular mixture and for practical systems can vary from fractions of millimeters to meters. In larger channels, such as channel 101, detonation cannot be stopped by diffraction. Angles alpha α 114 and beta β116 should not change very much (see FIG. 1B).

And, further according to the third exemplary embodiment, and referring to FIG. 1B, FIG. 1C and FIG. 7, in the system 700, propagation and suppression of the detonation front by diffraction in the detonation diode(s) 150-1, 150-2, and 150-3 occur when the ratio of the pocket 104 length L to the channel height H in the sawtooth geometry of the detonation diode(s) 150-1, 150-2, and 150-3 equals 2 (approximately); this relationship is characterized as:

$$L/H=2, \tag{2}$$

where L is the pocket 104 length, and where H is the channel height.

Further according to the third exemplary embodiment, and referring to FIG. 1B, FIG. 1C and FIG. 7, in the system 700, propagation of the detonation front by diffraction, convergent sections of the sawtooth geometry promotes detonation propagation from a small channel to a large channel.

While the exemplary embodiments have been particularly shown and described with reference to preferred embodiments thereof, it will be understood by those skilled in the art that the preferred embodiments including any first, second and/or third exemplary embodiments have been presented by way of example only, and not limitation; furthermore, various changes in form and details can be made therein without departing from the spirit and scope of the invention. Thus, the breadth and scope of the present exemplary embodiments should not be limited by any one or more of the above described preferred exemplary embodiment(s), but should be defined only in accordance with the following claims and their equivalents. All references cited herein, including issued U.S. patents, or any other references, are each entirely incorporated by reference herein, including all data, tables, figures, and text presented in the cited references. Also, it is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one of ordinary skill in the art.

The foregoing description of the specific embodiments will so fully reveal the general nature of the invention that others can, by applying knowledge and skill within the art, readily modify and/or adapt for various applications such specific embodiments, without undue experimentation, without departing from the general concept of the present invention. Therefore, such adaptations and modifications are intended to be within the meaning and range of equivalents of the disclosed embodiments claimed herein and below, based on the teaching and guidance presented herein and the claims that follow:

What is claimed is:

1. A gaseous mixture flow apparatus that promotes a supersonic detonation propagation of a plurality of gaseous mixtures in one direction and suppresses the supersonic detonation propagation of the plurality of gaseous mixtures in an opposite direction, the apparatus comprising:

a detonation diode configured to allow a supersonic detonation propagation in a first direction, suppress the supersonic detonation propagation in a second direction opposite the first direction via diffraction phenomena, and to not obstruct fluid flow therethrough, and including:

a channel having:

a first end of the channel having a first opening, wherein a plurality of gaseous mixture flows enters the channel;

a second end of the channel having a second opening where the plurality of gaseous mixture flows exits the channel; and a plurality of surfaces, wherein an at least first surface of the plurality of surfaces has an at least three consecutive divergent sections formed as a sawtooth shape geometry on the at least first surface of the channel, and wherein the at least three consecutive divergent sections are separated by a plurality of wedges and a plurality of pockets having a plurality of angled walls formed in the at least first surface as the sawtooth shape geometry and, because of the plurality of pockets formed in the sawtooth shape geometry, the sawtooth shape geometry causes suppression of any supersonic detonation of the gaseous mixture flow through the sawtooth shape geometry via diffraction phenomena in a first direction in the channel, and causes propagation of the supersonic detonation of the gaseous mixture flow in a second direction in the channel, and wherein the detonation diode is free from obstruction restriction in one of an operation of collection, transmission and distribution of the plurality of gaseous mixture flows, wherein the plurality of pockets are distributed symmetrically about the channel, wherein a leading wall of each pocket forms an angle alpha ($\alpha$) with a surface of the channel, wherein $\alpha$ has a value in a range from 14 degrees to 20 degrees, and herein a trailing wall of each pocket forms an angle beta ($\beta$) with a surface of the channel, wherein $\beta$ has a value in a range from 27 degrees to 30 degrees.

2. The gaseous mixture flow apparatus according to claim 1, wherein the detonation diode is composed of one of plastics, steel, or carbon steel.

3. The gaseous mixture flow apparatus according to claim 1, wherein the channel is a rectangular channel having four surfaces including the at least first surface, a second surface, a third surface and a fourth surface, where the at least first surface is the top surface of the channel, wherein the third surface is the bottom surface of the channel and the second and the fourth surfaces are side walls of the channel, and wherein the plurality of pockets includes a first pocket, a second pocket and a third pocket of the plurality of pockets formed in the at least first surface as the sawtooth shape, and wherein a length of an opening of each pocket is 2 cm.

4. The gaseous mixture flow apparatus according to claim 3, wherein the channel includes any width W.

5. The gaseous mixture flow apparatus according to claim 3, wherein the channel includes any height H from the at least first surface of the channel to the third surface of the channel, and wherein the channel includes a height h having a value in a range of 0.5 cm to 1 cm from the first surface of the channel to a top surface of each pocket of the sawtooth shape geometry formed in the channel.

6. The gaseous mixture flow apparatus according to claim 3, wherein the plurality of pockets includes a fourth pocket, a fifth pocket and a sixth pocket of the plurality of pockets formed in the third surface of the channel.

7. The gaseous mixture flow apparatus according to claim 4, wherein the plurality of pockets includes a seventh pocket, an eighth pocket and a ninth pocket of the plurality of pockets formed in the second surface of the channel.

8. The gaseous mixture flow apparatus according to claim 4, wherein the plurality of pockets includes a tenth pocket, an eleventh pocket and a twelfth pocket of the plurality of pockets formed in the fourth surface.

9. The gaseous mixture flow apparatus according to claim 1, wherein the channel is a circular pipe channel including a diameter D, wherein the plurality of pockets includes a first pocket, a second pocket and a third pocket of the plurality of pockets formed in a surface of the circular pipe as the sawtooth shape, and wherein a length of an opening of each pocket in the sawtooth shape is 2 cm.

10. The gaseous mixture transmission system according to claim 1, wherein a ratio of a channel height H to a pocket height h in the sawtooth geometry of the detonation diode equals 2; wherein this relationship is characterized as:

$$H/h=2, \tag{1}$$

where H is the channel height, and where h is the pocket height, thereby suppressing the detonation front by diffraction.

11. The gaseous mixture transmission system according to claim 1, wherein a ratio of a pocket length L to the channel height H equals 2 (approximately) in the sawtooth geometry of the detonation diode; this relationship is characterized as:

$$L/H=2, \tag{2}$$

where L is the pocket length, and where H is the channel height, thereby suppressing the detonation front by diffraction.

* * * * *